US011279016B2

(12) United States Patent
Kurz et al.

(10) Patent No.: US 11,279,016 B2
(45) Date of Patent: Mar. 22, 2022

(54) HAND-HELD POWER TOOL

(71) Applicant: Robert Bosch GmbH, Stuttgart (DE)

(72) Inventors: Andre Kurz, Dettenhausen (DE); Thomas Brinkmann, Aichtal-Groetzingen (DE); Lars Schmid, Nuertingen (DE); Pascal Schmitz, Leinfelden-Echterdingen (DE); Hardy Schmid, Stuttgart (DE); Patrick Heinen, Ludwigsburg (DE); Jan Koalick, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 16/613,789

(22) PCT Filed: Jun. 1, 2018

(86) PCT No.: PCT/EP2018/064459
§ 371 (c)(1),
(2) Date: Nov. 14, 2019

(87) PCT Pub. No.: WO2018/228829
PCT Pub. Date: Dec. 20, 2018

(65) Prior Publication Data

US 2021/0170560 A1 Jun. 10, 2021

(30) Foreign Application Priority Data

Jun. 12, 2017 (DE) ..... 10 2017 209 829.5

(51) Int. Cl.
*B25D 11/00* (2006.01)
*B25D 17/04* (2006.01)
(Continued)

(52) U.S. Cl.
CPC ..... *B25D 11/005* (2013.01); *B25D 17/043* (2013.01); *B25D 17/084* (2013.01);
(Continued)

(58) Field of Classification Search
CPC .. B25D 11/005; B25D 11/125; B25D 16/006; B25D 2216/0084; B25D 2217/0019;
(Continued)

(56) References Cited

U.S. PATENT DOCUMENTS 6,015,017 A * 1/2000 Lauterwald ..... B25D 16/006 173/109
6,241,026 B1 * 6/2001 Wache ..... B23Q 3/12 173/132
(Continued)

FOREIGN PATENT DOCUMENTS

DE 100 02 748 A1 8/2001
EP 1 052 070 A2 11/2000
(Continued)

OTHER PUBLICATIONS

International Search Report corresponding to PCT Application No. PCT/EP2018/064459, dated Sep. 27, 2018 (German and English language document) (6 pages).

*Primary Examiner* — Thanh K Truong
*Assistant Examiner* — David G Shutty
(74) *Attorney, Agent, or Firm* — Maginot, Moore & Beck LLP

(57) ABSTRACT

A system includes first and second power tools that each have a percussion mechanism, a motor, and a transmission. The transmission includes a striking mechanism and is configured to transfer a driving motion of the motor to an insert tool held in a tool holder. The transmission has a guide tube that is identical in some regions along a working axis and accommodates a striker. The guide tube is rotatably coupled to the motor by a first transmission unit. The striker is driven to linearly oscillate by a piston of a second transmission unit. A ratio between a diameter of the tool holder and a diameter of the guide tube is 1.8 times greater in the first power tool than in the second power tool. A
(Continued)

striking energy of the second power tool is mechanically reduced compared to a striking energy of the first power tool.

12 Claims, 17 Drawing Sheets

(51) Int. Cl.
*B25D 17/08* (2006.01)
*B25D 11/12* (2006.01)
*B25D 16/00* (2006.01)

(52) U.S. Cl.
CPC ..... *B25D 11/125* (2013.01); *B25D 16/006* (2013.01); *B25D 2216/0084* (2013.01); *B25D 2217/0019* (2013.01); *B25D 2250/131* (2013.01); *B25D 2250/165* (2013.01); *B25D 2250/275* (2013.01)

(58) Field of Classification Search
CPC ..... B25D 2250/131; B25D 2250/165; B25D 2250/275; B25D 17/043; B25D 17/084
USPC ..... 173/51
See application file for complete search history.

(56) References Cited

U.S. PATENT DOCUMENTS

| | | | | |
|---|---|---|---|---|
| 6,666,283 | B2 * | 12/2003 | Frauhammer ..... | B25B 23/141 173/93 |
| 9,102,044 | B2 * | 8/2015 | Hartmann ..... | B25D 17/06 |
| 2009/0133893 | A1 * | 5/2009 | Zhong ..... | B25D 17/06 173/201 |

FOREIGN PATENT DOCUMENTS

| | | | |
|---|---|---|---|
| EP | 1 584 422 | A1 | 10/2005 |
| EP | 2 522 467 | A1 | 11/2012 |
| WO | 2016/172480 | A1 | 10/2016 |

* cited by examiner

HAND-HELD POWER TOOL

This application is a 35 U.S.C. § 371 National Stage Application of PCT/EP2018/064459, filed on Jun. 1, 2018, which claims the benefit of priority to Serial No. DE 10 2017 209 829.5, filed on Jun. 12, 2017 in Germany, the disclosures of which are incorporated herein by reference in their entirety.

BACKGROUND

Prior Art

Hammer drills having eccentric percussion mechanisms of differing power classifications are already known, both as battery-powered appliances and as mains-powered appliances.

In addition, DE 10002748 A1 describes a hammer drill having a safety coupling for transmitting a torque, the safety coupling having two coupling elements, which are connected to each other via a latching element that disengages if a defined torque is exceeded.

SUMMARY

The disclosure relates to a system composed of a first hand-held power tool and a second hand-held power tool, each having a percussion mechanism, each having a motor, each having a transmission that comprises the percussion mechanism and that is designed to transmit a driving motion of the motor to an insert tool accommodated in a tool receiver, wherein the respective transmissions have a guide tube that is identical in regions along a working axis and in which a striker is carried in an axially movable manner, wherein the guide tube is rotatably coupled to the motor via a first transmission unit, and wherein the striker can be driven in a linearly oscillating manner via a piston of a second transmission unit.

The hand-held power tool is designed, in particular, to drive an insert tool rotationally about a working axis and/or percussively along a working axis. The working axis extends substantially along the longitudinal extent of the first or the second hand-held power tool. The insert tool may be realized, by way of example, as a drill bit or chisel. The insert tool is a wearing part that can be detachably fastened in the tool receiver. The insert tool has an insertion end, which is accommodated in the tool receiver of the hand-held power tool. The insertion ends of insert tools usually have a standardized shank diameter, which is designed for differing appliance classes, or appliance sizes, for example a 10 mm shank diameter for SDS-plus tool receivers, and an 18 mm shank diameter for SDS-max tool receivers.

The tool receiver preferably comprises a changeable drill chuck or a fixed drill chuck. A "guide tube that is identical in regions along a working axis" is to be understood to mean, in particular, a guide tube that, in at least 33%, preferably at least 50%, in particular at least 66% of the length of the guide tube, along the longitudinal extent of the hand-held power tool, is identical to another guide tube. In particular, the internal and/or external diameter of the guide tube of the first hand-held power tool and of the second hand-held power tool are/is identical, at least in regions, along the working axis. The guide tube of the first and/or the second hand-held power tool may be realized as one or more parts. In particular, the guide tube of the first hand-held power tool and of the second hand-held power tool is identical in a region between the rear end, which faces away from the tool receiver, and a control opening or the B percussion damping system. In addition, a ratio between a diameter of the tool receiver and a diameter of the guide tube in the case of the first hand-held power tool is 1.8 times greater than in the case of the second hand-held power tool. A "diameter of the tool receiver" is to be understood to mean, in particular, an internal diameter of the tool receiver, which is matched to the shank size of the insert tool. A "diameter of the guide tube" is to be understood to mean, in particular, the internal diameter of the guide tube.

It is proposed that a single-strike energy of the second hand-held power tool be mechanically reduced in comparison with a single-strike energy of the first hand-held power tool. This makes it possible, advantageously, for the second hand-held power tool to be easily adapted to a different field of application. A "single-strike energy" is to be understood to mean, in particular, the energy that is transmitted to the striker during operation of the hand-held power tool, or that is transmitted from the striker to the insert tool. "Mechanically reduced" is to be understood to mean, in particular, that the single-strike energy is reduced by the transmission, preferably by the second transmission unit of the transmission. Preferably, the single-strike energy of the second hand-held power tool is reduced by at least 10%, in particular at least 17.5%, preferably by at least 25%. In absolute numbers, in the case of a diameter of the guide tube of approximately 30 mm, this corresponds to a reduction of the per-stroke energy of over 0.5 joules, in particular 1.5 to 2.0 joules. Additionally or alternatively, it is proposed that the percussive power of the second hand-held power tool be mechanically reduced in comparison with a percussive power of the first hand-held power tool. Preferably, the strike frequency of the percussion mechanism of the first hand-held power tool is substantially identical to the strike frequency of the second hand-held power tool.

Furthermore, it is proposed that a crank stroke of the second transmission unit of the second hand-held power tool be reduced in comparison with a crank stroke of the second transmission unit of the first hand-held power tool, in particular is reduced by 10%, preferably by 15%, more preferably by 20%. This makes it possible, advantageously, for the single-strike energy to be reduced, with a strike frequency remaining unchanged. A crank stroke is to be understood to mean, in particular, the axial distance between the two reversal points of the piston in the guide tube. In particular, no axial force acts upon the piston at the two reversal points.

Furthermore, it is proposed that the piston of the first and of the second hand-held power tool be driven via a respective eccentric unit, wherein an eccentricity of the eccentric unit of the second hand-held power tool is less than an eccentricity of the eccentric unit of the first hand-held power tool. Advantageously, the crank stroke can thereby easily be adjusted. The eccentric unit is assigned to the second transmission unit. The eccentric unit is driven about a rotation axis by the motor. The eccentric unit has a transmission element, realized as an eccentric pin, which is connected to the piston via a crank element. The transmission element moves on an, in particular, circular path about the rotation axis. The eccentricity of the eccentric unit ensues from the distance between the rotation axis of the eccentric unit and the path on which the transmission element moves.

It is additionally proposed that an air-spring length of the percussion mechanism of the first hand-held power tool differ from an air-spring length of the percussion mechanism of the second hand-held power tool, in particular is greater. Advantageously, a lesser air-spring length of the percussion mechanism enables the single-strike energy to be reduced in a structurally simple manner. An air-spring length of the percussion mechanism is to be understood to mean, in particular, a minimum distance between the striker and the piston, or a distance between the striker and the piston at the front reversal point that faces toward the tool receiver. The air-spring length may be adjusted, for example, via the shape of the striker, the shape of the piston or the shape of the crank element.

Furthermore, it is proposed that a bearing distance of the percussion mechanism of the first hand-held power tool be equal to a bearing distance of the percussion mechanism of the second hand-held power tool. A bearing distance in this case is to be understood to mean, in particular, a distance between two regions via which the guide tube of the percussion mechanism is carried. In particular, the bearing distance is as a distance between an axial or radial bearing and a further axial or radial bearing that each carry the guide tube. Preferably, the bearing distance is realized as a distance between two radial bearings.

Furthermore, it is proposed that a strike point of the first hand-held power tool be the same as a strike point of the second hand-held power tool. A strike point is to be understood to mean, in particular, the position of the striker, in particular of the rear end of the striker that faces away from the tool receiver, in the guide tube while the insert tool is being pressed against the surface on which work is to be performed. Preferably, both the strike point and the air-spring length of the first hand-held power tool are identical to the strike point and the air-spring length of the second hand-held power tool.

It is additionally proposed that the first and the second hand-held power tool each have a B percussion damping system, which are identical to each other. A B percussion damping system is to be understood to mean, in particular, an arrangement of components in the percussion mechanism that are designed to damp the recoil of the insert tool contrary to the direction of percussion. The striker transmits its energy to the insert tool via a bolt element. The B percussion damping system is arranged, at least partly, in the guide tube, and comprises at least one damping element, which may be arranged inside and/or outside of the guide tube. Preferably, the mass ratio between the bolt element and the striker in the case of the first hand-held power tool is identical to the second hand-held power tool, such that the same B percussion damping system can advantageously be optimized both to the first and to the second hand-held power tool.

Furthermore, it is proposed that the first and the second hand-held power tool each have a transmission housing, wherein the mechanical components within the transmission housing are at least 80%, in particular at least 90%, identical. The transmission housing may be realized as an external housing and/or as an internal housing.

Furthermore, it is proposed that a diameter of the tool receiver of the second hand-held power tool be under 18 mm, in particular is 10 mm, and that the ratio between a diameter of the guide tube and the diameter of the tool receiver of the second hand-held power tool lie in a range of between 2.8 and 3.4, in particular in a range of between 2.9 and 3.1. This makes it possible, advantageously, to realize a particularly powerful hand-held power tool.

Furthermore, the disclosure relates to a hand-held power tool having a percussion mechanism, having a motor, having a transmission that comprises the percussion mechanism and that is designed to transmit a driving motion of the motor to an insert tool accommodated in a tool receiver, wherein the transmission has a guide tube in which a striker is carried in an axially movable manner, wherein the guide tube is rotatably coupled to the motor via a first transmission unit, and wherein the striker can be driven in a linearly oscillating manner via a piston of a second transmission unit. It is proposed that the ratio between a diameter of the guide tube and a diameter of the tool receiver lie in a range of between 2.8 and 3.4, in particular in a range of between 2.9 and 3.1. Advantageously, the diameter of the tool receiver is under 18 mm, in particular is 10 mm.

Furthermore, the disclosure relates to a hand-held power tool having a percussion mechanism, having a motor, having a transmission that comprises the percussion mechanism and that is designed to transmit a driving motion of the motor to a tool receiver, wherein the transmission has a guide tube in which a striker is carried in an axially movable manner, wherein the guide tube is rotatably coupled to the motor via a first transmission unit, and wherein the striker is coupled to the motor via a second transmission unit that comprises an eccentric unit and can be driven in a linearly oscillating manner via a piston. It is proposed that an eccentricity of the eccentric unit can be set to at least two differing positions in such a manner that a crank stroke of the second transmission unit is altered. Advantageously, the single-strike energy of the percussion mechanism can thereby be adjusted.

It is additionally proposed that the eccentricity of the eccentric unit can be set in such a manner that the percussion mechanism is switched off. This makes it possible, advantageously, to realize a change of operating mode of the hand-held power tool, from a chiseling mode or a hammer-drilling mode to a drilling mode. Preferably, the eccentricity can be set in such a manner that, in the position with the least eccentricity, the crank stroke of the second transmission unit is reduced in such a manner that the striker of the percussion mechanism does not execute any striking motion.

Furthermore, it is proposed that the eccentricity of the eccentric unit can be set manually. Advantageously, it is thereby easy to realize mechanical setting of the eccentricity. Manual setting is to be understood to mean, in particular, that the eccentric unit is coupled to an actuation element via which the eccentricity can be set by means of a force exerted by a user of the hand-held power tool.

Furthermore, it is proposed that the eccentricity of the eccentric unit can be set semi-automatically. Advantageously, the eccentricity can thereby be set in a convenient manner. Semi-automatic setting is to be understood to mean, in particular, that the eccentricity can be selected by the user of the hand-held power tool, but the changeover is effected under the control of a set of electronics of the hand-held power tool.

It is additionally proposed that the eccentricity of the eccentric unit can be set automatically. Advantageously, setting of the eccentricity of the eccentric unit can thereby be realized in a particularly convenient manner. Automatic setting in this case is to be understood to mean, in particular, that the eccentricity cannot be selected or set by the user, but is fully controlled, by open-loop or closed-loop control, via a set of electronics.

Furthermore, it is proposed that the eccentric unit have a first eccentric element, which is carried so as to be rotatable about the rotation axis of the eccentric unit, and a second eccentric element, which is carried so as to be rotatable about the rotation axis and a setting axis. Preferably, the setting axis is parallel to the rotation axis. In particular, during operation of the hand-held power tool, the first and the second eccentric element are driven about the rotation axis. The second eccentric element is rotatably connected to the first eccentric element, in particular is rotatably fastened on the second eccentric element. In particular, the distance between the rotation axis and the setting axis if fixed, and thus cannot be altered.

Furthermore, it is proposed that the eccentric unit comprise a setting unit, which is designed to rotate the second eccentric element about the setting axis. Advantageously, the eccentricity can thereby be set in a selective manner. The setting unit is designed, in particular, to adjust and/or fix the second eccentric element in at least two differing positions.

It is additionally proposed that the setting unit have at least two mutually corresponding setting elements, which are designed to establish a non-positive and/or positive connection between the second eccentric element and one of the setting elements. Preferably, at least one of the setting elements, in particular both setting elements, is/are carried so as to be rotatable about the setting axis.

Furthermore, it is proposed that one of the setting elements be realized as an external toothing of the second eccentric element. In particular, the setting element is realized integrally with the second eccentric element. The external toothing may be arranged partially or fully on an outer circumference of the second eccentric element.

Furthermore, it is proposed that one of the setting elements be realized as an actuator element, which is carried in a pivotable and/or linearly movable manner, wherein the actuator element is connected to the setting element corresponding to the actuator element only during a setting operation. The actuator element is designed, in particular, so as to be controllable via a set of electronics, in such a manner that an electrical signal of the set of electronics is converted into a mechanical movement of the actuator element.

It is additionally proposed that one of the setting elements be realized as an internally toothed gear. Furthermore, it is proposed that the internally toothed gear be carried so as to be rotatable about the rotation axis. Furthermore, it is proposed that the internally toothed gear can be driven and/or braked via a drive element. In particular, the internally toothed gear may be realized as part of a planetary transmission.

It is additionally proposed that the piston be coupled to an eccentric pin of the eccentric unit via a crank element. The crank element may be realized, for example, as a crank bar or as a connecting-rod element. Via the crank element, the rotary motion of the eccentric pin is concomitantly converted into a linear motion of the piston. The eccentric pin is preferably connected in a rotationally fixed manner to the second eccentric element, and thus so as to be rotatable about the rotation axis and the setting axis.

Furthermore, the disclosure relates to an overload device for a hand-held power tool, which is designed to limit a torque that is transmitted from a motor of the hand-held power tool to a tool receiver of the hand-held power tool, having a first coupling element and a second coupling element, which can be coupled to each other in a rotationally fixed manner via an overload unit, wherein the overload unit is arranged in a linearly movable manner between the first and the second coupling element. It is proposed that the overload unit is carried in a tiltable manner in the overload device. Advantageously, the wear on the overload device can thereby be reduced significantly.

The overload device is realized, in particular, as a coupling, via which a motor shaft of the motor is separably connected to the guide tube in such a manner that, beyond a threshold value, a torque of the motor is no longer transmitted to the guide tube. Preferably, the first coupling element is coupled to the motor shaft, and the second coupling element is coupled to the guide tube. The coupling may be effected, for example, via a spur gear transmission or a bevel gear transmission. The overload device is carried so as to be rotatable about a coupling axis. The coupling axis is preferably realized parallel to a drive axis of the motor shaft. The second coupling element is fastened, in particular, in a rotationally fixed manner on a coupling shaft. The overload unit is carried, in particular, so as to be linearly movable relative to the first and the second coupling element. The overload unit is preferably carried so as to be linearly movable radially in relation to the coupling axis. Alternatively or additionally, it is also conceivable for the overload unit to be carried parallel to the coupling axis or at an angle in relation to the coupling axis. The overload unit may be realized so as to be fully or partially tiltable. In particular, a tilt axis of the overload unit is substantially parallel to the coupling axis of the overload device.

Furthermore, it is proposed that the overload unit have an overload element, to which a force is applied by a spring element. This makes it possible, advantageously, to realize secure coupling of the two coupling elements. In particular, the overload element applies a force to an inner surface of the first coupling element. The overload device preferably has a plurality of overload units, in particular six to eight, preferably seven. The overload units are arranged, in particular, symmetrically around the coupling axis.

It is additionally proposed that the overload element be accommodated in a tiltable manner in a recess of the second coupling element. In particular, the overload element is accommodated with play in the recess of the second coupling element. Preferably, the overload element is accommodated in a tiltable manner in the recess in such a manner that the spring element is guided so as to be movable only axially in the overload element.

Furthermore, it is proposed that the distance between the recess and the overload element varies. Advantageously, an angle about which the overload unit can be tilted can thereby be defined in a structurally simple manner. Advantageously, the distance between the recess and the overload element increases, in particular continuously, in the direction of the coupling axis. In particular, the recess and/or the overload element are/is conical. Preferably, the outer surface and/or the inner surface of the overload element are/is conical. Conical in this context is to be understood to mean, in particular, that the inner surface of the recess, or the inner or outer surface of the overload element, extends, at least partially, with a slight angular offset in relation to the linear direction of motion. The angular offset may be, in particular, less than 10°, preferably less than 6°, more preferably less than 3°.

Furthermore, it is proposed that the spring element be accommodated in a tiltable manner in the overload element. Preferably, as a result, both the overload element and the spring element can tilt relative to the second coupling element. Preferably, during operation of the hand-held power tool, the spring element tilts about an angle different from that of the overload element.

It is additionally proposed that the spring element be guided exclusively by the overload element. Advantageously, it is thereby possible to realize reliable guiding of the spring element. Preferably, in each operating state, at most 95% of the spring element is surrounded by the overload element.

Furthermore, it is proposed that the spring element comprise five springing windings. Advantageously, this makes it possible to realize a particularly compact overload device that, at the same time, has a high transmissible transmission power. In particular, the spring element has a total of seven windings.

Furthermore, the disclosure relates to a hand-held power tool having an overload device as previously described, having a percussion mechanism, having a motor, having a transmission that comprises the percussion mechanism and that is designed to transmit a driving motion of the motor to a tool receiver, wherein the transmission has a guide tube in which a striker is carried in an axially movable manner, wherein the guide tube is rotatably coupled to the motor via a first transmission unit, and wherein the striker, coupled to the motor via a second transmission unit that comprises an eccentric unit, can be driven in a linearly oscillating manner via a piston. This makes it possible, advantageously, to realize a very compact and powerful hand-held power tool.

It is additionally proposed that the first transmission unit have a ratio between height and length in a range of between 1.3 and 1.5, in particular in a range of between 1.35 and 1.45. This makes it possible, advantageously, to realize a compact hand-held power tool having an optimized centre of gravity.

Furthermore, it is proposed that a diameter of the tool receiver be over 10 mm, in particular is 18 mm, and that a ratio between a diameter of the guide tube and the diameter of the tool receiver lie in a range of between 1.35 and 2.00, in particular in a range of between 1.6 and 1.8. Advantageously, this makes it possible to realize a particularly compact and powerful hand-held power tool.

Furthermore, the disclosure relates to a hand-held power tool, in particular a hammer drill, having a housing, which has at least three housing parts, which are connected to each other via housing interfaces, wherein the first housing part is fastened to the second housing part via a first housing interface, and is fastened to the third housing part via a second housing interface. It is proposed that the second housing part be fastened to the third housing part via the first housing interface. Advantageously, this makes it possible to realize an inexpensive and compact housing structure.

In this context, two housing parts that are connected to each other are to be understood to mean, in particular, two housing parts that are directly fastened to each other. The housing interfaces are designed, in particular, to fasten at least two housing parts to each other such that they are movable relative to each other, immovable or rotatable. Preferably, the housing interfaces having damping elements, which are designed to damp vibrations that occur during operation of the hand-held power tool. The damping elements may be realized, for example, as elastic or springing elements, for example as spring elements or a rubber ring.

It is additionally proposed that the housing interfaces each have at least two mutually corresponding connection elements, which are each assigned to one of the two housing parts that are connected to each other. The connection elements may be realized integrally with the housing parts, or as separate components. The connection elements are designed, in particular, to connect the housing parts in a non-positive and/or positive manner.

Furthermore, it is proposed that a connection element of the first housing part be connected, in particular in a positive manner, to a connection element of the second housing part, and to a connection element of the third housing part. This makes it possible, advantageously, to reduce the structural space within the housing that is occupied by the housing interfaces. In particular, one of the connection elements is encompassed in a positive manner by the other two connection elements.

Furthermore, it is proposed that the second housing part be immovably fastened to the first housing part, and the third housing part be movably fastened to the first housing part. Preferably, a motor is arranged in the first housing part, a set of electronics is arranged in the third housing part, and the second housing part is realized as a handle. This makes it possible, advantageously, to realize a modular housing structure. The set of electronics of the hand-held power tool is designed, in particular, to control the hand-held power tool. Advantageously, the third housing part has a mains electric power interface or a battery interface.

It is additionally proposed that the housing have an outer housing, and an inner housing, in which a transmission is arranged, wherein at least one of the housing parts is realized as an outer housing. Advantageously, as a result of the transmission being arranged in an inner housing, the transmission can be carried securely. An inner housing is to be understood to mean, in particular, a housing part that is encompassed, at least partially, in particular fully, by a housing part realized as an outer housing.

Furthermore, it is proposed that at least one of the housing parts, in particular the first housing part, be formed from two housing half-shells. The housing half-shells may be connected to each other, for example, by means of a screwed connection.

Furthermore, it is proposed that the hand-held power tool be realized as a battery-powered hand-held power tool. Alternatively or additionally, it is proposed that the hand-held power tool be realized as a mains-powered hand-held power tool.

Furthermore, the disclosure relates to a system composed of a hand-held power tool, in particular a hammer drill, having a housing, which has at least three housing parts, which are connected to each other via housing interfaces, wherein the first housing part is fastened to the second housing part via a first housing interface, and is fastened to the third housing part via a second housing interface, and of a further hand-held power tool, in particular a hammer drill, having a housing, which has at least three housing parts, which are connected to each other via housing interfaces, wherein the first housing part is fastened to the second housing part via a first housing interface, and is fastened to the third housing part via a second housing interface, wherein the hand-held power tool is realized as a battery-powered hand-held power tool and the further hand-held power tool is realized as a mains-powered hand-held power tool. It is proposed that the first housing part of the hand-held power tool be realized such that it is identical to the first housing part of the further hand-held power tool. Advantageously, owing to the modular housing structure, the same housing part can be used for hand-held power tools having differing energy supplies.

It is additionally proposed that the system have an additional hand-held power tool, in particular a hammer drill, having a housing, which has at least three housing parts, which are connected to each other via housing interfaces, wherein the first housing part is fastened to the second housing part via a first housing interface, and is fastened to the third housing part via a second housing interface, wherein a diameter of a tool receiver of the hand-held power tool differs from a diameter of a tool receiver of the additional hand-held power tool, and the first housing part of the additional hand-held power tool is realized such that it is identical to the first housing part of the hand-held power tool and of the further hand-held power tool. Advantageously, owing to the modular housing structure, the same housing part can be used for hand-held power tools of differing power classifications.

BRIEF DESCRIPTION OF THE DRAWINGS

Further advantages are evident from the following description of the drawings. The drawings, the description and the claims contain numerous features in combination. Persons skilled in the art will expediently also consider the features individually and combine them to form appropriate, further combinations.

There are shown.

DETAILED DESCRIPTION

Figure 1:
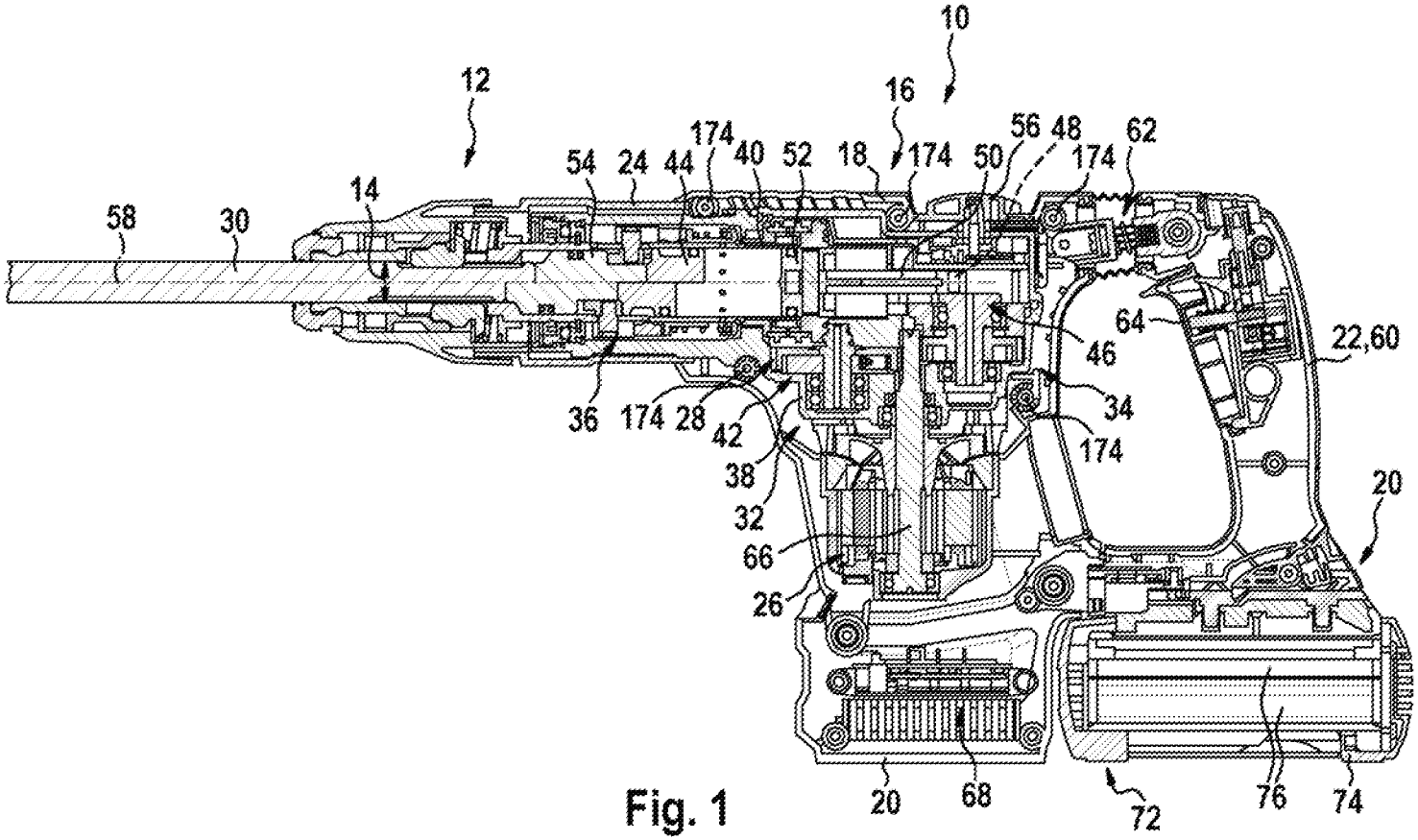
FIG. 1 a longitudinal section of a first hand-held power tool.

The following drawings show four variants of a hand-held power tool. The hand-held power tools are designed to comprise as many identical components as possible, in order to cover differing fields of application in a cost-effective manner. In the following, identical components and identical assemblies are denoted by the same reference numeral. The different variants of the hand-held power tool are identified by the number of apostrophes suffixed to the reference numerals. Differing embodiment of components or assemblies that are assigned to one or more specific variants of the hand-held power tool are likewise denoted by the same number of apostrophes. Alternative embodiments of the components or assembles that in principle are possible for at least two variants are denoted by a letter after the reference numeral.

The first hand-held power tool 10 (see FIG. 1) and the second hand-held power tool 10' (see FIG. 2) are realized as battery-powered hand-held power tools. The two hand-held power tools 10, 10' each have a tool receiver 12, 12', which differ from each other in their diameter 14, 14'. In particular, in addition, the tool receiver 12 is realized as a fixed drill chuck and the tool receiver 12' is realized as a changeable drill chuck. For example, the first hand-held power tool 10 is realized with an SDS-max tool receiver 12, and the second hand-held power tool 10' is realized with an SDS-plus tool receiver 12'. The diameter 14 of the SDS-max tool receiver 12 is substantially 18 mm, and the diameter 14' of the SDS-plus tool receiver 12' is substantially 10 mm, resulting in a ratio of 1.8 between the diameter 14 of the tool receiver 12 of the first hand-held power tool 10 and the diameter 14' of the tool receiver 12' of the second hand-held power tool 10'. The third hand-held power tool 10" (see FIG. 9*c*) and the fourth hand-held power tool 10''' (see FIG. 9*d*) are each realized as mains-powered hand-held power tools, having an SDS-max tool receiver 12 and an SDS-plus tool receiver 12'.

FIG. 1 shows a longitudinal section through the first hand-held power tool 10. The hand-held power tool 10 is realized as a hammer drill. The hand-held power tool 10 has a housing 16, which is formed from a plurality of housing parts 18, 20, 22, 24. The housing parts 18, 20, 22, 24 are realized as an outer housing. Alternatively or additionally, it is also conceivable for at least one of the housing parts 18, 20, 22, 24 to be realized, partially or fully, as an inner housing. Arranged within the first housing part 18 is a motor 26. In the variants of the hand-held power tool 10, 10' as a battery operated hand-held power tool, the motor 26 is realized as a direct-current motor, in particular a brushless direct-current motor, and in the variants of the hand-held power tool 10", 10''' as a mains-operated hand-held power tool, it is realized as an alternating-current motor, for example as a synchronous motor, asynchronous motor or universal motor. Preferably, the moors 26 of the hand-held power tools 10, 10', 10", 10'''' are optimized to the same characteristics, such that the ratio between rotational speed and torque at relevant operating points is substantially identical. A driving motion of the motor 26 is transmitted via a transmission 28 to the tool receiver 12, in which an insert tool 30 is detachably accommodated. The transmission 28 has a first transmission unit 32, a second transmission unit 34 and a percussion mechanism 36. The transmission 28 is accommodated in a transmission housing 38, which is realized as an inner housing, in particular composed of metal. Alternatively, however, it is also conceivable for the transmission housing 38 to be realized, at least partially, as an outer housing.

The first transmission unit 32 is designed to couple the motor 26 in a rotatable manner to a guide tube 40 of the percussion mechanism 36. The first transmission unit 32 comprises an overload device 42, which is designed to limit the maximum torque that can be transmitted from the motor 26 to the guide tube 40.

The second transmission unit 34 is designed to covert the rotatory driving motion of the motor 26 into a linear motion of a striker 44, which is carried and guided in a linearly movable manner in the guide tube 40. The second transmission unit 34 comprises an eccentric unit 46, which has a transmission element 48, realized as an eccentric pin, which is connected to a piston 52 via a crank element 50. The piston 52 is guided in a linearly movable manner in the guide tube 40.

The percussion mechanism 36 comprises the guide tube 40, the striker 44 and a bolt element 54, which is likewise guided in a linearly movable manner in the guide tube 40, and via which the energy of the striker 44 is transmitted to the insert tool 30. The guide tube 40 has a diameter, in particular an internal diameter, of 30 mm, enabling a high single-strike energy to be realized. Thus, in the case of the first hand-held power tool 10, a ratio of approximately 1.7 is obtained between a diameter of the guide tube 40 and the diameter 14 of the tool receiver 12.

The hand-held power tool 10 has a plurality of operating modes, which can be set via an operating-mode switchover element 56. The operating-mode switchover element 56 has at least three switching positions, one switching position corresponding to a drilling mode, a further switching position corresponding to a hammer-drilling mode, and yet a further switching position corresponding to a chiseling mode.

Via the tool receiver 12, the insert tool 30 is coupled to the transmission 28, in particular to the guide tube 40 and to the bolt element 54, in a rotationally and translationally movable manner. During operation of the hand-held power tool 10, the insert tool 30 rotates about a working axis 58 and/or oscillates along the working axis 58.

The hand-held power tool 10 extends lengthwise along the working axis 58. The tool receiver 12 is arranged at the front end of the hand-held power tool 10, and the third housing part 22, realized as a handle 60, is realized at the rear end of the hand-held power tool 10. The handle 60 is pivotably fastened to the first housing part 18 and to the second housing part 20. In addition, the handle 60 is fastened to the first housing part 18 via a damping unit 62. Arranged on the handle 60 is an operating element 64, which is realized as an operating switch for switching the hand-held power tool 10 on and off.

Height-wise, the hand-held power tool 10 extends substantially parallel to a longitudinal extent of the handle 60 and/or parallel to the longitudinal extent, in particular to a motor shaft 66, of the motor 26. The transmission 28 is arranged above the motor 26. Arranged beneath the motor 26 is a set of electronics 68, which is designed to control the hand-held power tool 10, in particular the motor 26 of the hand-held power tool 10, by closed-loop or open-loop control. The set of electronics 68 is arranged in the second housing part 20. Arranged at the lower end of the handle 60 is a battery interface 70, via which a hand-held power tool battery pack 72 can be detachably fastened to the second housing part 22, which is realized as a handle 60. The hand-held power tool battery pack 72 comprises a battery-pack housing 74, in which at least one battery cell 76, advantageously five or ten battery cells 76, are accommodated.

Figure 2:
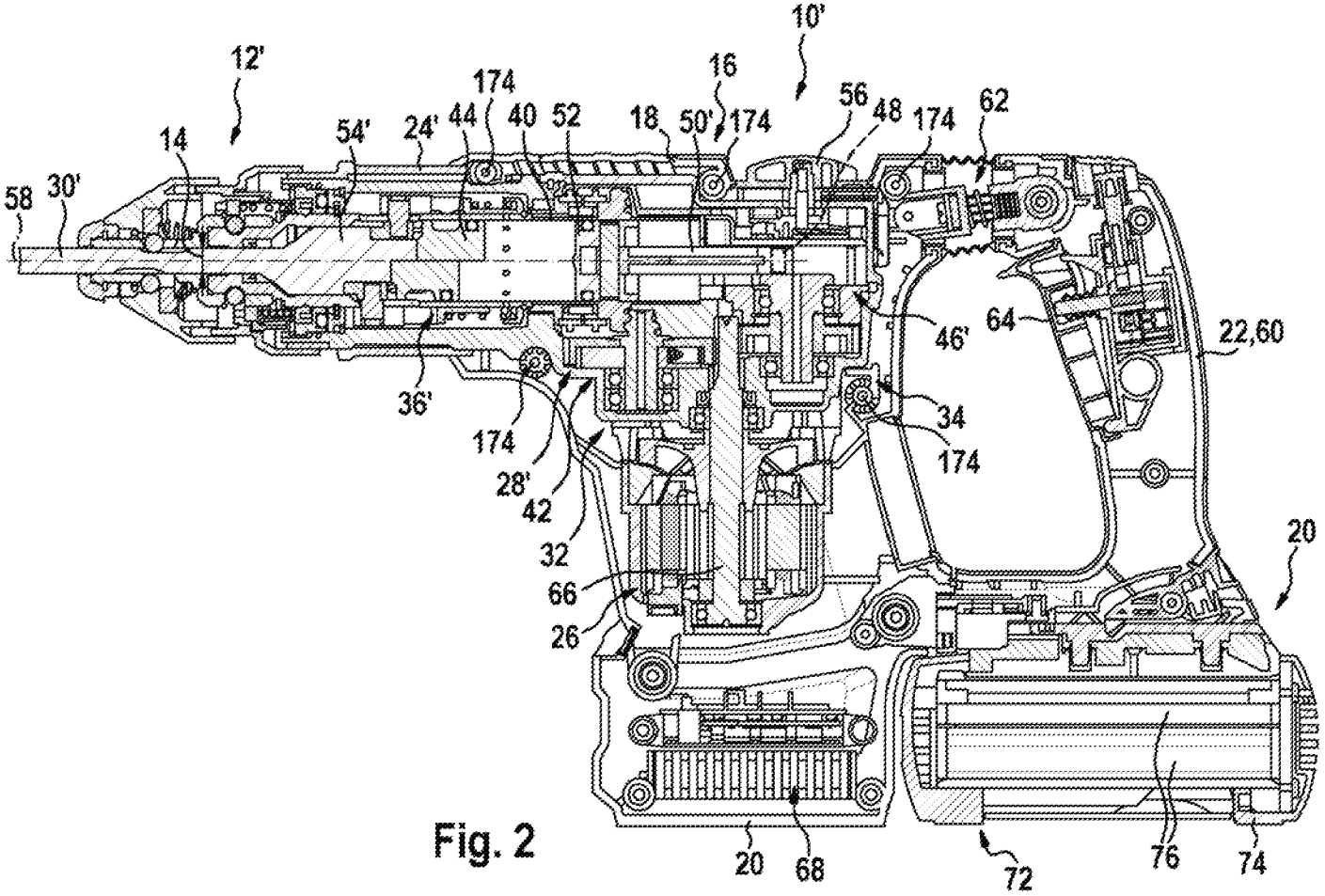
FIG. 2 a longitudinal section of a second hand-held power tool.

FIG. 2 shows a longitudinal section of the second hand-held power tool 10'. The majority of the component built into the hand-held power tool 10' in this case are identical to the components of the hand-held power tool 10. In particular, a guide tube 40' of the second hand-held power tool 10' is identical in regions to the guide tube 40 of the first hand-held power tool 10. In particular, the diameter of the guide tube 40' of the second hand-held power tool 10' is identical to the diameter of the guide tube 40 of the first hand-held power tool 10. Thus, for example, diameter of the guide tube 40' is likewise 30 mm. Thus, in the case of the second hand-held power tool 10, a ratio of 3.0 is obtained between a diameter of the guide tube 40' and the diameter 14' of the tool receiver 12'.

Since the tool receiver 12' of the second hand-held power tool 10' is designed for smaller insert tools 30', or for insert tools 30' having smaller shank diameters, a lesser single-strike energy is required for driving of the insert tool 30' by the second hand-held power tool 10' than for driving of the insert tool 30 by the first hand-held power tool 10. In order to mechanically reduce the single-strike energy acting upon the insert tool 30', the transmission 28' of the second hand-held power tool 10' differs from the transmission 28 of the first hand-held power tool 10 in a few components. In particular, the percussion mechanism 36' of the second hand-held power tool 10' has a different bolt element 54'. In addition, the second transmission unit 34' of the second hand-held power tool 10' has a different crank element 50', and an eccentric unit 46' that differs in its eccentricity.

The transmissions 28, 28' of the two hand-held power tools 10, 10', and the differences between them, are described in greater detail in the following with reference to FIG. 3*a* and FIG. 4.

Figure 3A:
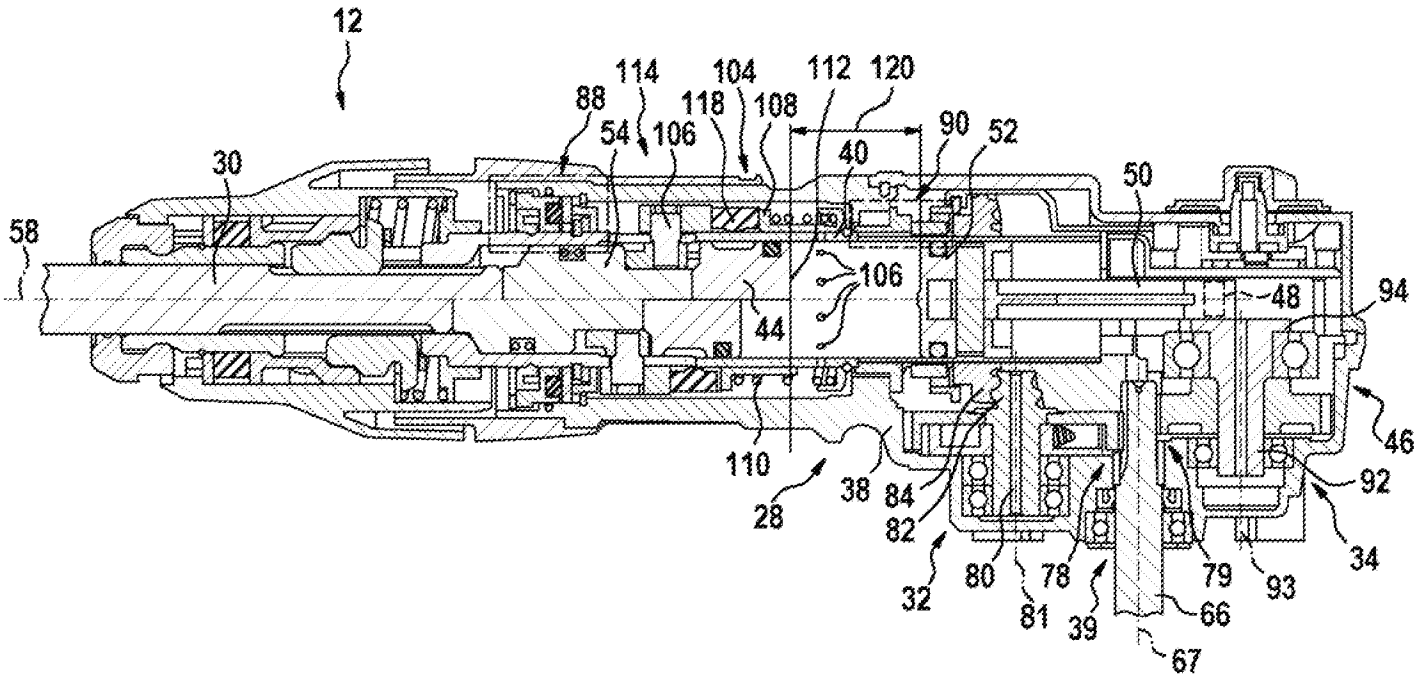
FIG. 3*a* a longitudinal section of a transmission of the first hand-held power tool.

FIG. 3*a* shows the transmission 28 and the tool receiver 12 of the first hand-held power tool 10. On its underside, the transmission housing 38 has an opening, realized as a drive interface 39, in which the motor shaft 66 of the motor 26 is carried in a rotatable manner. The drive interface 39 comprises bearing elements and sealing elements, and is standardized for the differing variants of the hand-held power tools 10, 10', 10" and 10'", such that, for example, both direct-current motors, in particular brushless direct-current motors, as well as alternating-current motors, can be accommodated. The first transmission unit 32 and the second transmission unit 34 are rotatably coupled to the motor shaft 66. In particular, both the first transmission unit 32 and the second transmission unit 34 are coupled directly to the motor shaft. Alternatively, it is also conceivable for the first and the second transmission unit 32, 34 to be coupled via each other to the motor shaft 66.

The first transmission unit 32 is coupled to the motor shaft 66 via a first spur gear transmission 78. The first spur gear transmission 78 is assigned to the overload device 42, via which the torque can be transmitted from the motor shaft 66 to the coupling shaft 80. In particular, the overload device 42 is pressed onto the coupling shaft 80. The coupling shaft 80 is carried so as to be rotatable about a coupling axis 81, the coupling axis 81 being substantially parallel to a drive axis 67 of the motor shaft 66. Pressed on at the upper end of the coupling shaft 80 is a pinion element 82, which is assigned to a bevel gear transmission 84. The bevel gear transmission 84 additionally comprises a ring gear 86, which is connected in a rotationally fixed manner to the guide tube 40. The guide tube 40 is rotatably carried in the housing 16, in particular in the transmission housing 38, via a first and a second bearing arrangement 88, 90. In the tool receiver 12, the insert tool 30 is rotatably connected to the guide tube 40, such that the insert tool 30 can be driven in rotation.

Figure 3B:
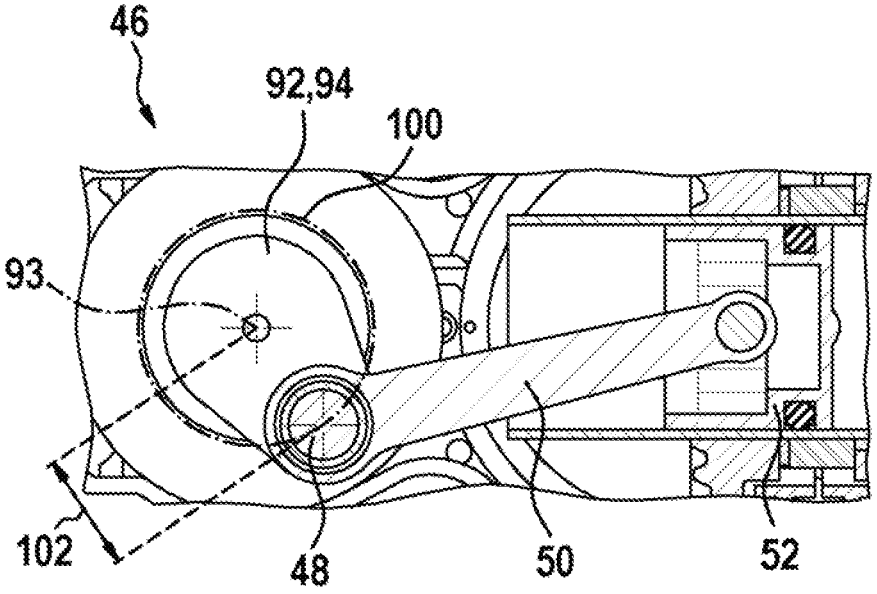
FIG. 3*b* a cross section of an eccentric unit of the transmission of the first hand-held power tool.

The second transmission unit 34 is coupled to the motor shaft 66 via a second spur gear transmission 79. Via the second spur gear transmission 79, the torque of the motor shaft 66 is transmitted to an eccentric shaft 92. The eccentric shaft 92 is carried in the transmission housing 38 so as to be rotatable about a rotation axis 93. Arranged on the top of the eccentric shaft 92 is an eccentric element 94 realized as an eccentric disk, the eccentric shaft 92 and the eccentric element 94 preferably being realized as a single piece. The transmission element 48, realized as an eccentric pin, is fixedly connected to the eccentric element 94. To aid illustration, the conversion of the rotational motion into a linear motion by the eccentric unit 46 is shown from above in FIG. 3*b*. The crank element 50 is realized as a connecting rod, which is rotatably connected to the transmission element 48 and rotatably connected to the piston 52. The transmission element 48 is arranged at a distance apart from the rotation axis 93 of the eccentric unit 46, and rotates about the rotation axis 93, along a circular path 100. The eccentricity 102 of the eccentric unit 46 ensues from the distance between the transmission element 48 and the rotation axis 93, or the distance between the circular path 100 and the rotation axis 93.

Figure 4:
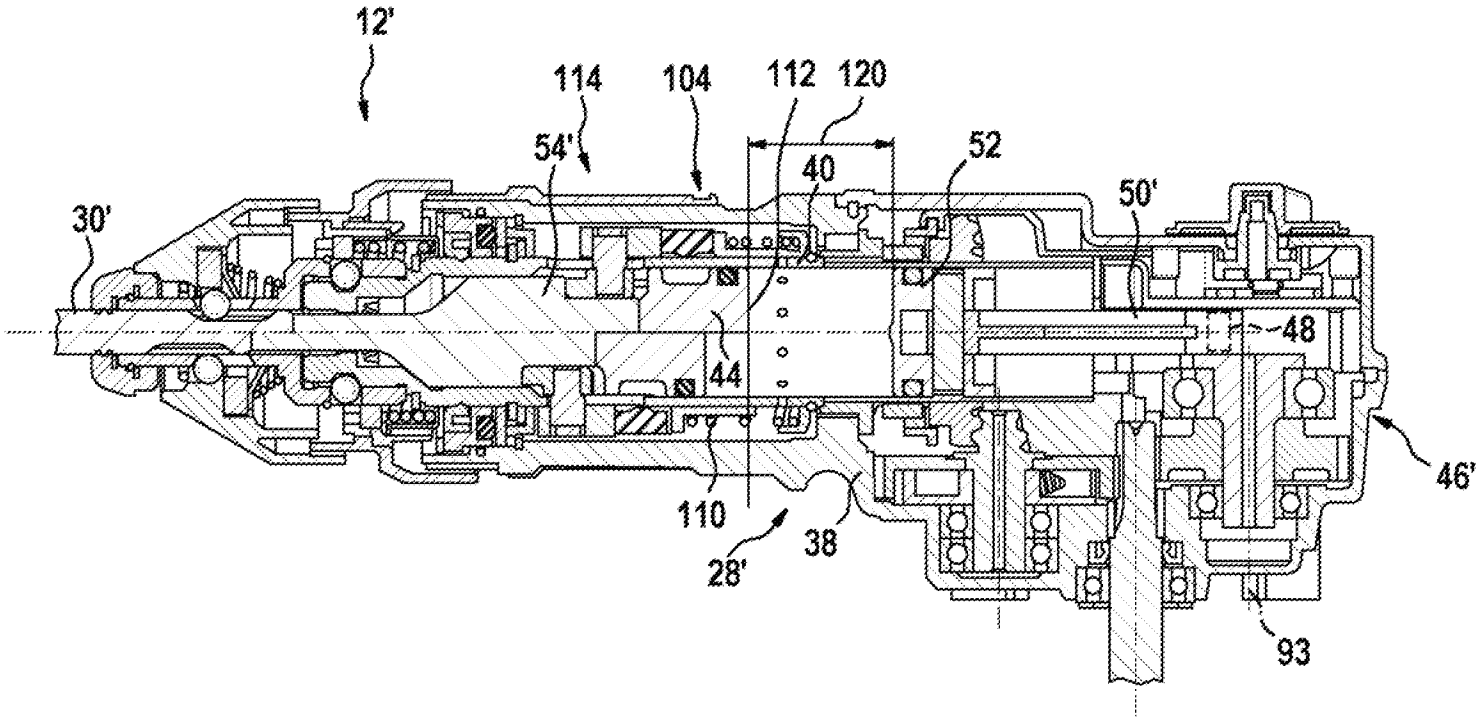
FIG. 4 a longitudinal section of a transmission of the second hand-held power tool.

The percussion mechanism 36 according to FIGS. 3 and 4 is realized as a pneumatic percussion mechanism. The percussion mechanism 36 has a percussion-mechanism controller 104, via which it can be changed over from an idling mode to a working mode. The percussion mechanism 36 is represented in the idling mode beneath the working axis 58, and represented in the working mode above the working axis 58. In the region between the striker 44 and the piston 52, the guide tube 40 has control openings 106, by means of which a pressure equalization, between the interior and the exterior of the guide tube 40, can be effected. The control openings 106 are realized such that they can be closed by means of a control sleeve 108, which is arranged outside of the guide tube 40. A force is applied to the control sleeve 108, in the direction of the idling position, by means of a spring element 110 that is realized as a spiral spring.

In order to switch the hand-held power tool 10 from the idling mode to the working mode, it is pressed, with an inserted insert tool 30, against a surface on which work is to be performed. Owing to the resultant acting force, the insert tool 30, the bolt element 54 bearing against the insert tool 30, and the striker 44 bearing against the bolt element 54 are displaced axially in the direction of the rear end of the guide tube 40. When the insert tool 30 is pressed upon, the position of the striker 44 is the strike point 112 of the percussion mechanism 36. The axial movement capability of the insert tool 30, or of the bolt element 54, is limited via a B percussion damping system 114. The B percussion damping system 114 is coupled in an axially movable manner to the percussion-mechanism controller 104. The B percussion damping system 114 is designed to damp the recoil of the insert tool 30. The movement of the insert tool 30 is transmitted by the bolt element 54 to a pin element 116 carried in a recess of the guide tube 40. A damping element 118 of the B percussion damping system 114, which is realized as a rubber ring, is arranged outside of the guide tube and is connected to the pin element 116. The damping element 118 bears against the control sleeve 108 of the percussion-mechanism controller 104, and displaces it in the working mode in such a manner that the control openings 106 of the guide tube 40 are closed by the control sleeve 108, contrary to the spring force of the spring element 110.

When the control openings 106 have been closed, an oscillating motion of the piston 52 between two axial reversal pints results in compression of the air cushion between the striker 44 and the piston 52, by means of which compression the striker 44 is driven percussively along the working axis 58. The distance between the strike point 112 and the front reversal point of the piston 52 is defined as an air-spring length 120.

FIG. 4 shows the transmission 28' and the tool receiver 12' of the second hand-held power tool 10'. By means of an approximately 20% reduction of a crank stroke of the piston 52, the single-strike energy of the striker 44 is reduced by 1.5 to 2.0 joules. In particular, in the case of the first hand-held power tool 10, the ratio between the diameter of the guide tube 40, 40' and the piston stroke is 1.8, in particular 1.77, and is 1.4, in particular 1.44, in the case of the second hand-held power tool 10'. In this case, the reduction of the crank stroke of the piston 52 is realized by means of a reduction of the eccentricity 102' of the eccentric unit 46' relative to the eccentric unit 46 of the first hand-held power tool 10. This is realized in that the transmission element 48 is arranged closer to the rotation axis 93 of the eccentric unit 46', than in the case of the first hand-held power tool 10. The adaptation of the eccentricity 102' of the second hand-held power tool 10' enables the single-strike energy acting upon the insert tool 30' to be optimally adapted.

The transmission 28 of the first hand-held power tool 10 and the transmission 28' of the second hand-held power tool 10' are accommodated in identical transmission housings 38. This is realized, in particular, in that the transmissions 28, 28' are largely the same. In particular, the bearing distance between the two bearing arrangements 88, 90 is identical for both hand-held power tools 10, 10'.

In particular, the guide tube 40 of the first hand-held power tool 10 is identical in regions, along the working axis 58, to the guide tube 40' of the second hand-held power tool 10'. In particular, the guide tubes 40, 40' are of identical design at least between their rear ends and the control openings 106, preferably at least between their rear ends and the percussion-mechanism controllers 104, more preferably between their rear ends and the B percussion damping systems 114. In particular, the diameter of the guide tubes 40, 40' is identical in the region of the piston 52 and in the region of the striker 44.

In addition, the first transmission unit 32 of the second hand-held power tool 10' is identical to the first transmission unit 32 of the first hand-held power tool 10.

Furthermore, the strike point 112 of the second hand-held power tool 10' is identical to the strike point 112 of the first hand-held power tool 10. This is realized, in particular, by the elongated shape of the bolt element 54' of the second hand-held power tool 10' in comparison with the bolt element 54 of the first hand-held power tool 10. In particular, the mass ratio between the bolt element 54 and the striker 44 of the first hand-held power tool 10 is substantially the same as the mass ratio between the bolt element 54' and the striker 44 of the second hand-held power tool 10'. Advantageously, the same B percussion-mechanism damping system 114 can consequently be optimized to both hand-held power tool 10, 10'.

Furthermore, the air-spring length 120 of the second hand-held power tool 10' is identical to the air-spring length 120 of the first hand-held power tool 10. This is realized in that the shorter crank stroke is compensated by an elongated crank element 50', such that the distance between the strike point 112 and the front reversal point of the piston 52 is the same.

Figure 5A:
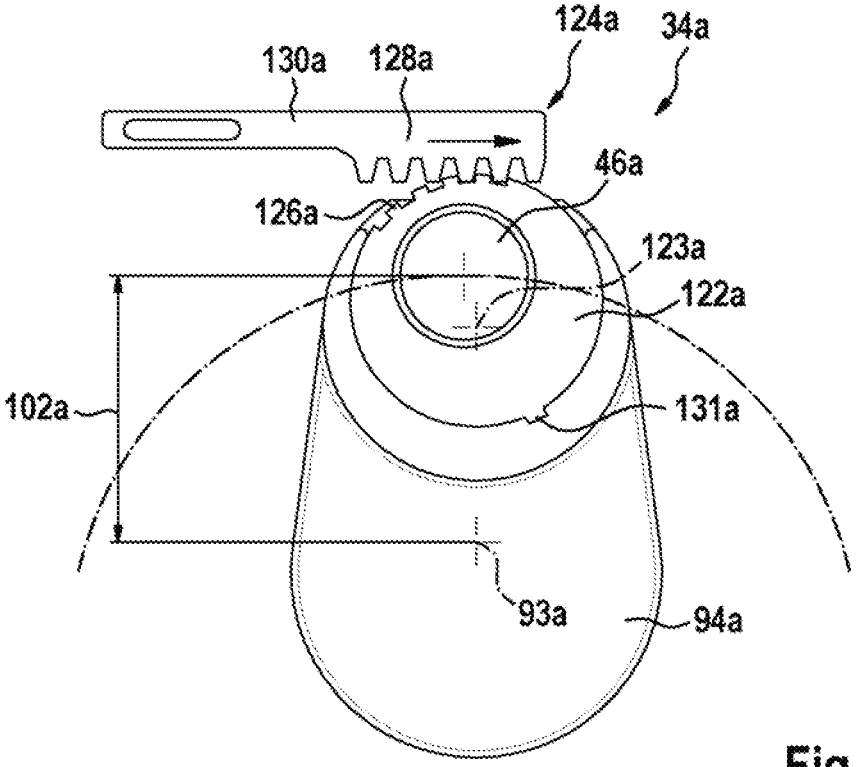
FIG. 5*a* a cross section of a second embodiment of the eccentric unit.
Figure 5B:
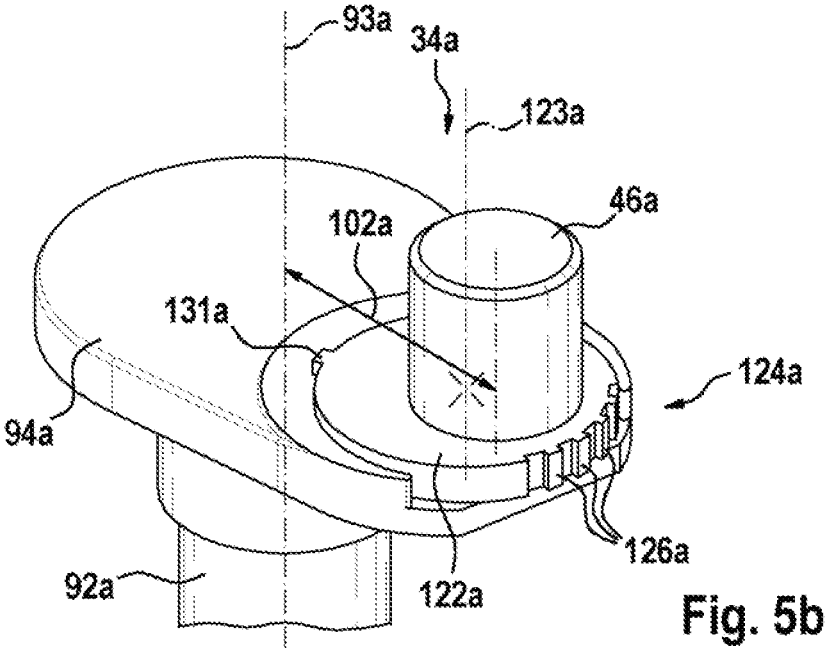
FIG. 5*b* a perspective view of the eccentric unit according to FIG. 5*a;*

Alternative embodiment of the eccentric unit 46*a* is shown in FIG. 5*a* and FIG. 5*b*, wherein, unlike the previous eccentric units 46, 46', the eccentricity 102*a* of the eccentric unit 46*a* is not fixed, but can be set. The eccentric unit 46*a* is shown in a cross section in FIG. 5*a*, and in a perspective view in FIG. 5*b*.

The eccentric unit 46*a*, as already described above, is designed to transmit a rotatory driving motion into a linear motion. The eccentric unit 46*a* has an eccentric element 94*a*, realized as an eccentric disk, which is carried so as to be rotatable about a rotation axis 93*a*. The eccentric unit 46*a* additionally comprises a second eccentric element 122*a*, realized as an eccentric disk, which is realized so as to be movable relative to the first eccentric element 94*a*. In particular, the second eccentric element 122*a* is carried so as to be rotatable about the rotation axis 93*a* and rotatable about a setting axis 123*a*. The second eccentric element 122*a* is accommodated, for example, partially by the first eccentric element 94*a*, but alternatively it is also conceivable for the second eccentric element 122*a* to be placed on the first eccentric element 94*a*. A transmission element 48*a*, realized as an eccentric pin, is connected to the second eccentric element 122*a* in a rotationally fixed manner. The eccentricity 102*a* of the settable eccentric unit 46*a* ensues from the distance between the circular path on which the transmission element 48*a* moves about the rotation axis 93*a*, and the rotation axis 93*a*.

Furthermore, the eccentric unit 46*a* comprises a setting unit 124*a*, which is designed to rotate the second eccentric element 122*a*, in particular the transmission element 48*a*, about the setting axis 123*a*, and to set it in at least two differing position, which each have a different eccentricity 102*a*. The setting unit 124*a* comprises two mutually corresponding setting elements 126*a*, 128*a*, which are designed to be connected to each other in a positive manner. The first setting element 126*a* is realized, as an external toothing, so as to constitute a single piece with the second eccentric element 122*a*. The second setting element 128*a* is realized as an actuator element 130*a*, which is accommodated, for example in a linearly movable manner, in the housing of the hand-held power tool. The actuator element 130*a* has a toothing that corresponds to the external toothing of the first setting element 126*a*. The toothings of the setting elements 126*a*, 128*a* are in engagement with each other in such a manner that a linear movement of the actuator element 130*a* is converted into a rotational movement of the second eccentric element 122*a* about the setting axis 123*a*. The rotational movement of the second eccentric element 122*a* is limited, by means of a stop 131*a*, between the two settable positions. The eccentric unit 46*a* has differing eccentricities 102*a* in the differing positions, with the result, advantageously, that the crank stroke can be varied.

Advantageously, the actuator element 130*a* can be controlled automatically or semi-automatically, by open-loop or closed-loop control, via a set of electronics of the hand-held power tool. Alternatively or additionally, it is also conceivable for the actuator element 130*a* to be mechanically coupled to an operating element, not represented, to enable manual actuation of the actuator element 130*a*.

An alternative embodiment of a settable eccentric unit 46*b* is shown in FIG. 6*a* to 6*d*. The eccentric unit 46*b* comprises an eccentric shaft 92*b*, and a first and a second eccentric element 94*b*, 122*b*, the first eccentric element 94*b* being carried so as to be rotatable about a rotation axis 93*b*, and the second eccentric element 122*b* being carried so as to be rotatable about the rotation axis 93*b* and the setting axis 123*b*. In addition, a transmission element 48*b* is connected to the second eccentric element 94*b* in a rotationally fixed manner.

The setting unit 124*b* of the eccentric unit 46*b* is designed to set the eccentricity 102*b* to a plurality of differing positions, between a maximum and a minimum eccentricity 102*b*. The setting unit 124*b* comprises two mutually corresponding setting elements 126*b*, 128*b*. The first setting element 126*b* is realized as an external toothing of the second eccentric element 122*b*. The second eccentric element 122*b* is realized, in particular, as a toothed wheel, which is arranged in a rotatable manner on the first eccentric element 94*b*. The second setting element 128*b* is carried in the housing so as to be rotatable about the rotation axis 93*b*. The second setting element 128*b* is in engagement with the first setting element 126*b* via a toothing that corresponds to the external toothing. The second setting element 128*b* is realized as an internally toothed gear 132*b*. The internally toothed gear 132*b* encompasses both the first and the second eccentric element 94*b*, 122*b*. Above the first eccentric element 94*b* the internally toothed gear 132 is in engagement with the second eccentric element 122*b* realized as a toothed wheel, and beneath the first eccentric element 94*b* the internally toothed gear 132*b* is in engagement with a drive element 134*b*. The drive element 134*b* is coupled to the internally toothed gear 132*b* via an end pinion. The drive element 134*b* may be driven and/or braked via a drive unit, not represented, that comprises, for example, a motor. Preferably, the internally toothed gear 132*b* is realized such that it can be driven, via the drive element 134*b*, independently from the first eccentric element 94*b*. Advantageously, the eccentricity 102*b* can be set via a relative movement of the internally toothed gear 132*b* in relation to the first eccentric element 94*b*. Preferably, during percussive operation of the hand-held power tool, the internally toothed gear 132*b* moves at the same rotational speed as the first eccentric element 94*b*, so that the eccentricity 102*b* of the eccentric unit 46*b* is constant during percussive operation. Alternatively, it is also conceivable for the eccentricity 102*b* to be varied during percussive operation. For example, the drive element 134*b* may be controlled by closed-loop control in such a manner that the eccentricity 102*b* preferably changes periodically, in order to generate a variable percussion-mechanism pressure.

Figure 6A:
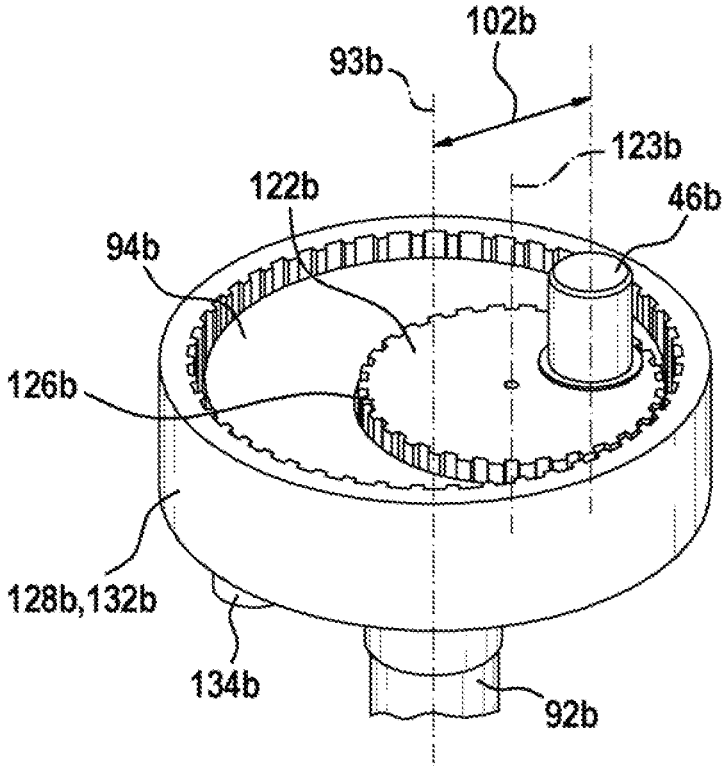
FIG. 6*a* a perspective view of a third embodiment of the eccentric unit.
Figure 6B:
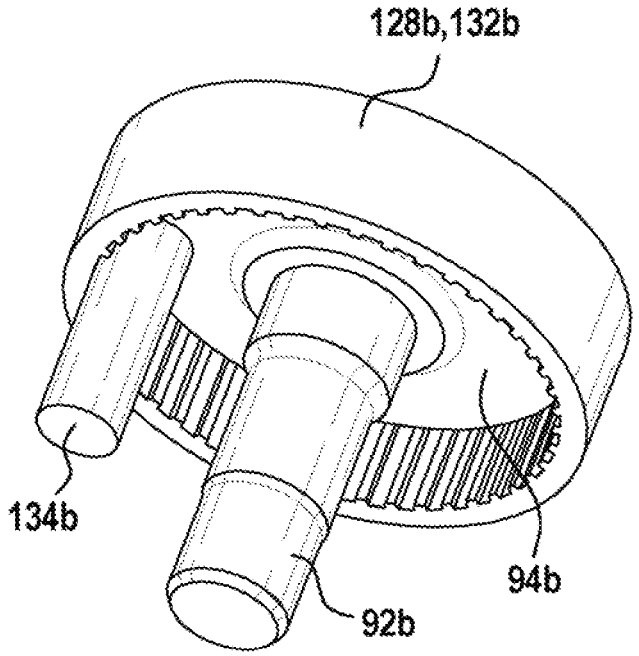
FIG. 6*b* a further perspective view of the eccentric unit according to FIG. 6*a;*
Figure 6C:
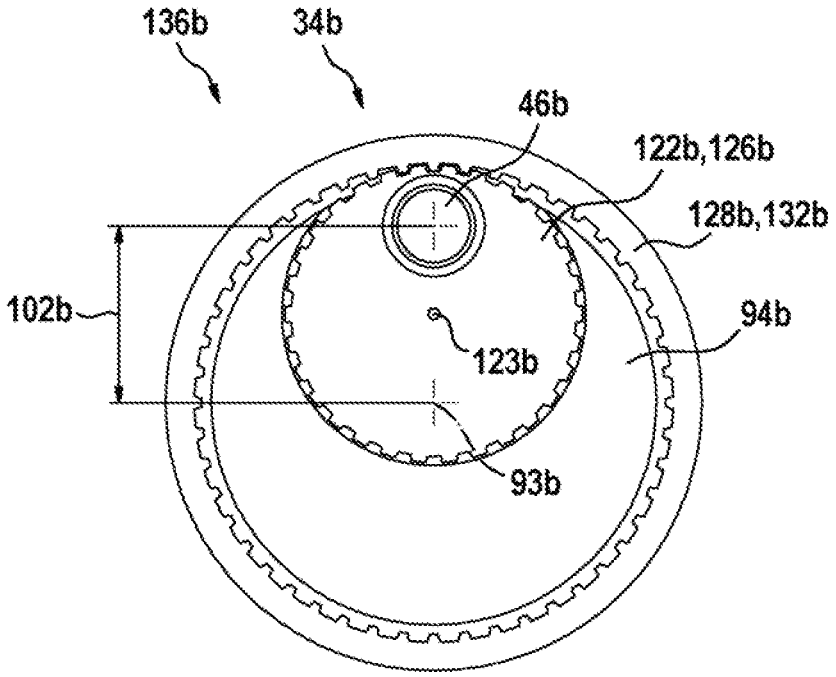
FIG. 6*c* a cross section of the eccentric unit according to FIG. 6*a;*
Figure 6D:
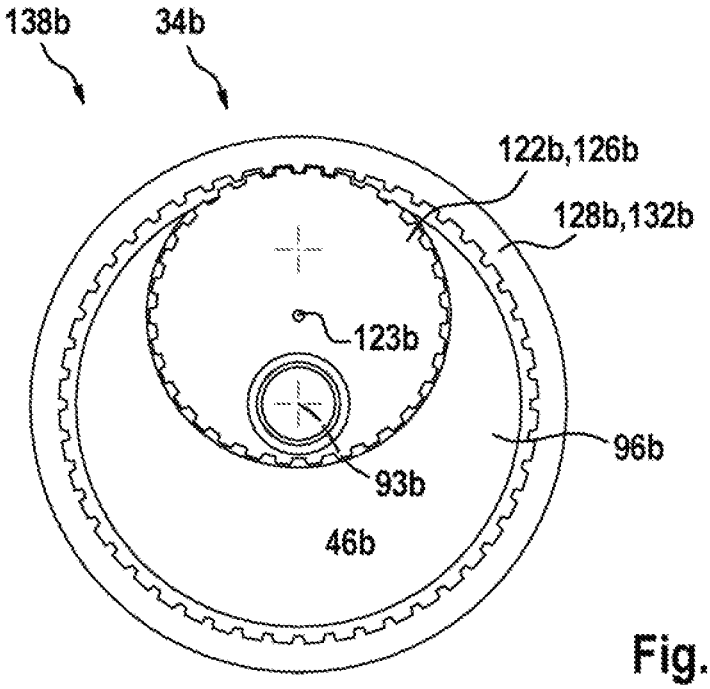
FIG. 6*d* a further cross section of the eccentric unit according to FIG. 6*a;*

In FIGS. 6*c* and 6*d*, the eccentric unit 46*b* is represented in a position 136*b* having a maximum eccentricity 102*b*, and in a position 138*b* having a minimum eccentricity 102*b*. The number of possible positions to which the second eccentric element 94*b* can be set, between the positions 136*b*, 138*b*, may be determined by the number of teeth of the toothings of the setting elements 126*b*, 128*b*. In the position 138*b* having the minimum eccentricity 102*b*, the transmission element 48*b* is arranged substantially centrally on the rotation axis 93*b*, such that the eccentricity 102*b* is substantially zero, and no crank stroke is produced by the eccentric unit 46*b* in this position. Advantageously, this enables the setting unit 124*b* to be designed to switch off a percussion mechanism of the hand-held power tool. Alternatively, it is also conceivable that the eccentric unit may be realized in a different manner, for example as described in U.S. Pat. No. 6,505,582.

Figure 7:
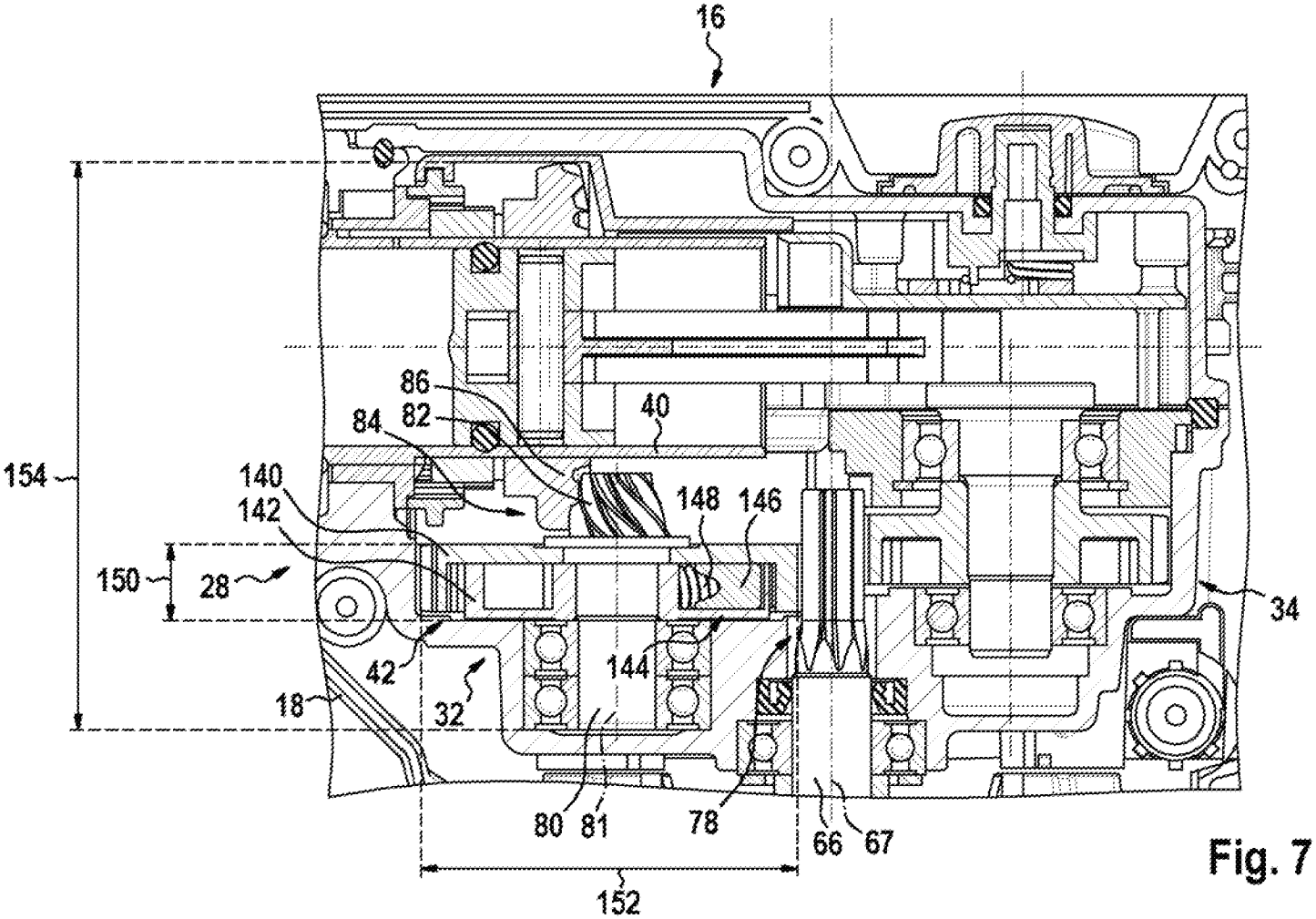
FIG. 7 an enlarged representation of the transmission according to FIG. 3.

The structure and the functioning of the overload device 42 is described in greater detail with reference to FIG. 7 to FIG. 8. Advantageously, the overload device 42 is realized in such a manner that a high transmissible transmission power can be realized with a small structural size and low weight.

The overload device 42 comprises a first coupling element 140 and a second coupling element 142, which are connected to each other in a rotationally fixed manner via an overload unit 144. In particular, the first coupling element 140 is coupled to the second coupling element 142 for the purpose of transmitting torque, provided that a maximum torque is not exceeded. Advantageously, the first coupling element 140 is decoupled from the second coupling element 142 if the maximum torque is exceeded. In the coupled state, the first and the second coupling element 140, 142 have the same rotational speed, whereas in the decoupled state the rotational speed of the first coupling element 140 differs from the rotational speed of the second coupling element 142.

The first coupling element 140 is realized as a part of a spur gear transmission 78. On its circumferential outer surface, the first coupling element 140 has a spur gear toothing, which meshes with the motor shaft 66. The second coupling element 142 is connected to the coupling shaft 80 in a rotationally fixed manner. The second coupling element 142 has recesses 145, which extend substantially radially, and in each of which an overload unit 144 is arranged in a linearly movable manner. The overload element 144 comprises an overload element 146, and a spring element 148, which applies a force to the overload element 146.

The compactness of the overload device 42 results, in particular, from the low height 150 and short length 152 of the overload device 42. Advantageously, the ratio between height 150 and length 152 of the overload device 42 is in a range of between 0.18 and 0.22. For example, in the exemplary embodiment shown, the ratio between height 150 and length 152 of the overload device 42 is approximately 0.20. In particular, the length 152 of the overload device 42 exceeds the diameter of the ring gear 86 by not more than 20%, preferably by not more than 10%. In the exemplary embodiment shown, the diameter of the ring gear 86 exceeds the length 152 of the overload device 42 by approximately 5%. Advantageously, the short length 152 of the overload device 42 also makes it possible to realize a first transmission unit 32 of a very compact structure. In particular, the ratio of the height 154 of the first transmission unit 32 to the length 156 of the first transmission unit 32, which corresponds to the length 152 of the overload device 42, is in a range of between 13 and 1.5. In the embodiment shown, the ratio is approximately 1.45.

Figure 8A:
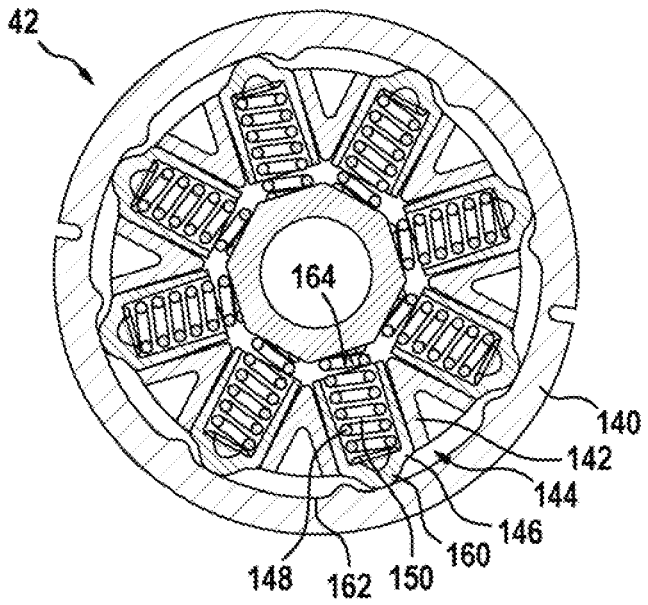
FIG. 8*a* a cross section of an overload device.

FIG. 8*a* shows a section through the overload device 42, in a cross section. The overload device 42 is in the coupled state.

The first coupling element 140 encompasses the second coupling element 142. The overload unit 144 is arranged in the recesses 145 of the second coupling element 142 in such a manner that the second coupling element 142 and the overload unit 144 are coupled to each other in a rotationally fixed manner about the coupling axis 81. The overload device 42 comprises seven recesses 145, in each of which an overload unit 144 is arranged. A force is applied to the overload element 146, radially in relation to the coupling axis 81, by the spring element 148. The head 160 of the overload element 146 impinges on the first coupling element 140, in particular a latching profile 162, on the inner circumferential surface of the first coupling element 140. The latching profile 162 comprises seven latching segments, corresponding to the number of recesses, which latching segments each have an ascending and a descending ramp. The latching segments are realized symmetrically, such that the slope of the ascending ramp is identical to the slope of the descending ramp. The rotational movement of the first coupling element 140 is thus coupled to the rotational movement of the second coupling element 142 by the overload unit 144.

If the insert tool 30 becomes jammed, the torque to be transmitted to the insert tool 30 from the motor shaft 66 via the first coupling element 140 can no longer be transmitted, since the coupling shaft 80 coupled to the insert tool is likewise jammed. There occurs a relative movement of the first coupling element 140, relative to the second coupling element 142, about the coupling axis 81, and the overload element 146 is pressed into the recess 145 by the latching profile 162, contrary to the spring force of the spring element 148. A slipping action occurs, in which the overload elements 146 slides from one pocket of the latching profile 162 into the next, until the jamming is removed or the hand-held power tool 10 is switched off. Advantageously, it can thereby be ensured that, in the event of the insert tool 30 becoming jammed, the hand-held power tool 10 does not rotate about the working axis 58. In the case of the slipping action, very high forces act upon the overload device 42, which can result in a very large amount of wear, and thus in a short service life of the overload device 42.

Figure 8B:
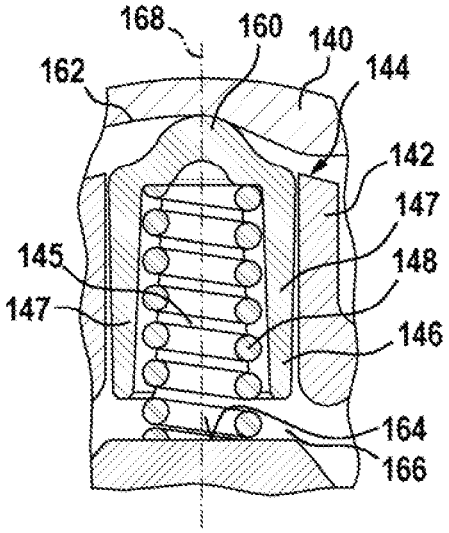
FIG. 8*b* an enlarged representation of an overload unit of the overload device according to FIG. 8*a;*

In FIG. 8*b*, the region marked in FIG. 8*a* is shown in an enlarged representation. The compact structural design is realized by a particularly compact spring element 148. The spring element 148 is realized as a helical compression spring. The spring element 148 comprises a total of seven windings, with five windings being designed to spring. In particular, the spring element has a spring stiffness of at least 50 N/mm with a dynamic stroke of up to 1.5 mm.

The spring element 148 bears axially against a flat stop surface 164 of the second coupling element 142, and against the overload element 146, in particular against an inner surface of the overload element 146 that is opposite the head 160. The spring element 148 is guided by the overload element 146. In particular, the overload element 146 has two guide arms 147, which are arranged opposite each other, and which guide the spring element 148. Both in the coupled and in the decoupled state the guide arms 147 are arranged in the recesses 145, whereas the head 160 is arranged partially in the recess 145 only in the decoupled state. The guide ratio between the length of the spring element 148 and the length of the region in which the spring element 148 is guided by the overload element 146 is approximately 1.13 in the coupled state. In the decoupled state (see FIG. 8*c*) the ratio falls to approximately 1.05. Preferably, the spring elements 148 is guided exclusively by the overload element 146. There is no guiding of the spring element 148 by the second coupling element 142. In particular, the recesses 145 of the second coupling element 142 are connected to each other via a circumferential groove 166, which extends around the coupling axis 81. The spring element 148 is partially arranged in this groove 166. In particular, in the region of the groove 166 the spring element 148 bears against the second coupling element 142. The spring element 148 has a constant diameter, in particular outer diameter.

The overload element 146 is accommodated in the recess 145 such that it is tiltable in a linearly movable manner. In particular, the distance between the recess 145 and the overload element 146, along a longitudinal extent 168 of the overload element 146 that, in particular when the overload device 42 is in the coupled state, extends coaxially with a radial extent 83 of the coupling axis 81, is not constant. Preferably, the distance between the recess 145 and the overload element 146 increases in the direction of the coupling axis 81, such that tilting is made possible. For example, the recess 145 is straight, and the overload element 146 is inclined or conical. Straight, in this case, is to be understood to mean, in particular, that the surface of the recess 145 against which the overload element 146 bears is substantially parallel to the longitudinal extent 168 of the overload element 146. Inclined, in this case, is to be understood to mean, in particular, that the outer surface of the overload element 146 has a slight angular offset, for example approximately 5°, relative to the longitudinal extent 168. Alternatively or additionally, it is also conceivable for the recess 145 to be inclined, or for the recess 145 to be inclined and the overload element 146 to be straight. To enable the overload element 146 to tilt without the spring element 148 being displaced by the overload element 146, the overload element 146 is also inclined, or conically shaped, on its inner surface. The distance between the spring element 148 and the overload element 146 thus also increases continuously in the direction of the coupling axis 81. Alternatively, it is also conceivable for the spring element 148 to be conical.

In particular, the guide arms 147 are inclined, or conically shaped, both on their inner side, which faces toward the spring element 148, and on their outer side, which faces toward the recess 145.

Figure 8C:
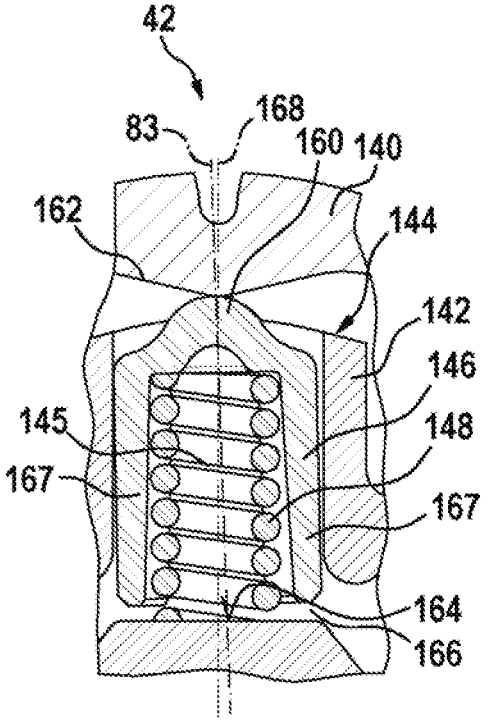
FIG. 8*c* a further enlarged representation of an overload unit of the overload device according to FIG. 8*a;*

FIG. 8*c* shows the overload device 42 in the decoupled state. As a result of a relative movement of the first coupling element 140 in relation to the second coupling element 142, the overload element 146, via the latching profile 162, is subjected to a force contrary to the force of the spring element 148. As a result, the overload element 146 moves, on the one hand, into the recess 145, in such a manner that the head 160 is also partially arranged in the recess 145, and on the other hand the overload element 146 is tilted. In particular, the overload element 146 is tilted in such a manner that the radial extent 83 and the longitudinal extent 168 of the overload element 146 have an angular offset of approximately 4°. In addition, owing to the conical shape of the guide arms 147, even upon tilting of the overload element 146 the guide arms 147 do not impinge on the spring element 148. This design makes it possible to realize a low-wear overload device 42 that has a particularly compact structure.

FIG. 9*a* to FIG. 9*d* show the hand-held power tools 10, 10', 10" and 10'", in a side view in each case. The housings 16, 16', 16", 16'" of the hand-held power tools 10, 10', 10", 10'" are based on a common housing concept, such that the first housing part 18 of the hand-held power tools 10, 10', 10", 10'" are identical.

Figure 9A:
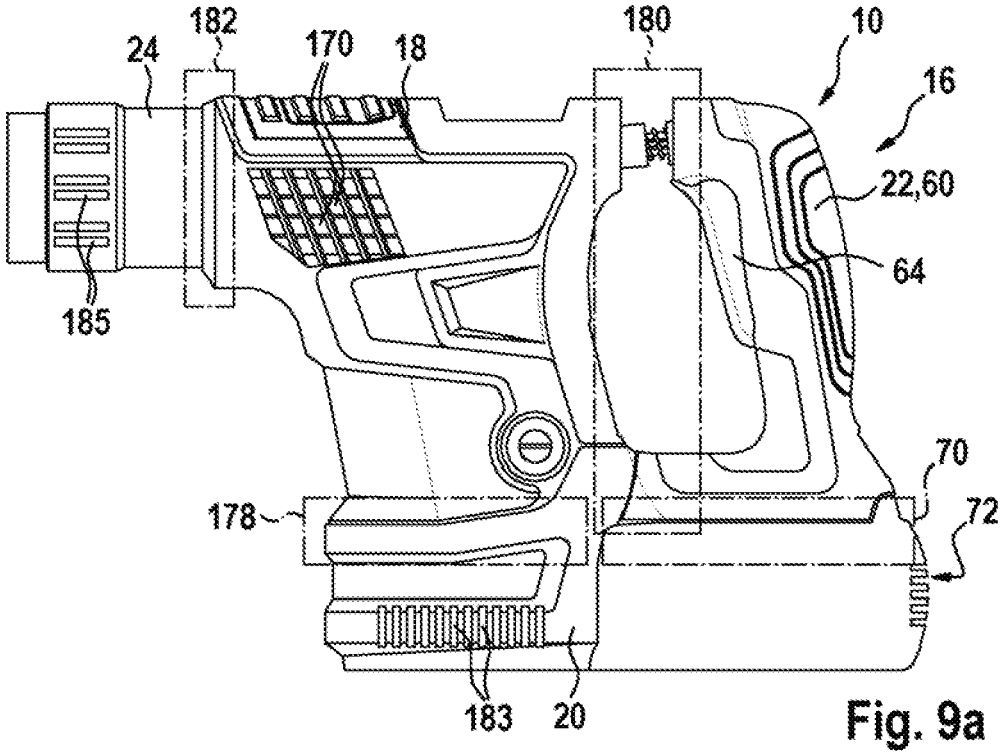
FIG. 9*a* a side view of a housing of the first hand-held power tool.

FIG. 9*a* shows the housing 16 of the first hand-held power tool 10. The first housing part 18 has two housing half-shells, which are joined to each other by means of screwed connections. The first housing part 18 encompasses the motor 26 and the transmission 28. In particular, the motor 26 and the transmission 28 are arranged substantially completely within the space spanned by the housing half-shells of the first housing part 18. The first housing part 18 comprises air openings 170, which are designed to supply the motor 26 and/or the transmission 28 with cooling air. In addition, an operating-mode switchover element 56 can be arranged in an opening 172 on the upper side of the first housing part 18. The transmission housing 38 is carried, by means of bearing points 174, in the first housing part 18. In particular, the transmission housing 38 is carried exclusively by the first housing part 18.

The first housing part 18 is connected to the second housing part 20, the third housing part 22 and the fourth housing part 24 via three housing interfaces 178, 180, 182.

Via the first housing interface 178, the second housing part 20 is immovably fastened to the first housing part 18. The second housing part 20 is realized as an electronics-set housing, in which the set of electronics 68 is arranged. Preferably, the second housing part 20 likewise comprises air openings 183, which are designed to cool the set of electronics 68. The second housing part 20 comprises two housing half-shells, which are connected to each other by means of a screwed connection.

The third housing part 22, realized as a handle 60, is movably fastened, via the second housing interface 180, to the first housing part 18. The operating element 64, realized as an operating switch, and the battery interface 70 are arranged on the third housing part 22. The third housing part 22 has two housing half-shells, which are connected to each other by means of a screwed connection.

At the front end of the hand-held power tool 10, the fourth housing part 24 is immovably fastened, via the third housing interface 182, to the first housing part 18. The fourth housing part 24 partially encompasses the tool receiver 12, and has air openings 185 for cooling. The fourth housing part 24 is realized as a single piece. In particular, the fourth housing part 24 is of a tubular shape.

Figure 9B:
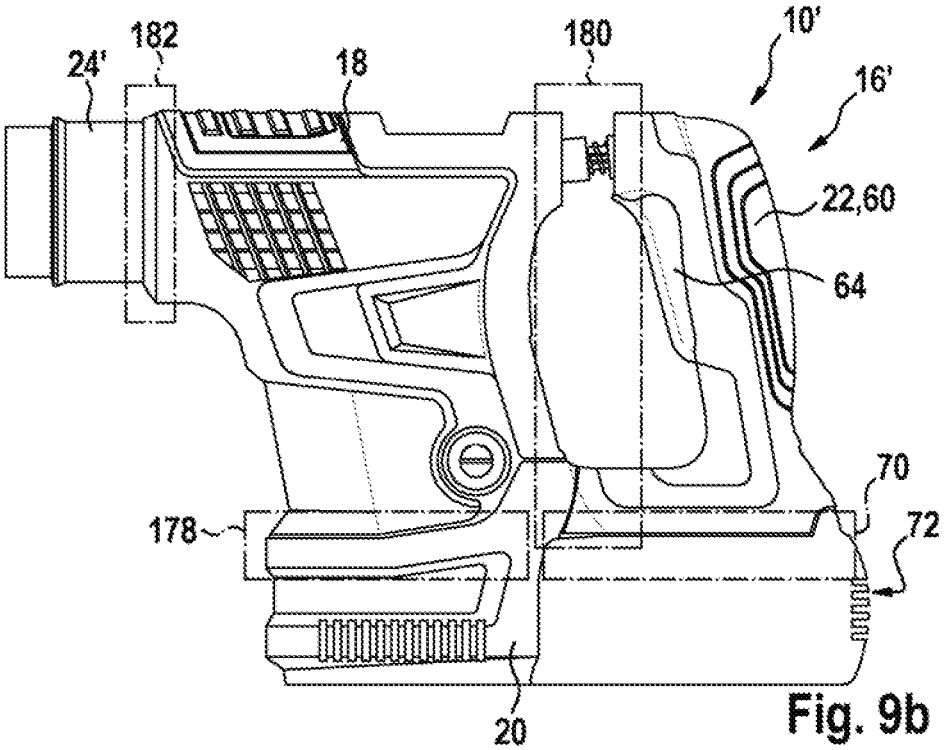
FIG. 9*b* a side view of a housing of the second hand-held power tool.

FIG. 9*b* shows the housing 16' of the second hand-held power tool 10'. Since the first hand-held power tool 10 and the second hand-held power tool 10' differ from each other substantially in the tool receivers 12, 12', the first, second and third housing part 18, 20, 22 of the two hand-held power tools 10, 10' are identical to each other. The fourth housing part 24' of the second hand-held power tool 10' differs from the fourth housing part 24 of the first hand-held power tool 10, in particular, in its compactness and length. Owing to the more compact tool receiver 12' of the second hand-held power tool 10', as compared with the tool receiver 12 of the first hand-held power tool 10, the housing 16' of the second hand-held power tool 10' can be adapted, by means of the fourth housing part 24', to the shape of the tool receiver 12'. In the case of the hand-held power tools 10, 10', the housing interfaces 182 are identical to each other.

Figure 9C:
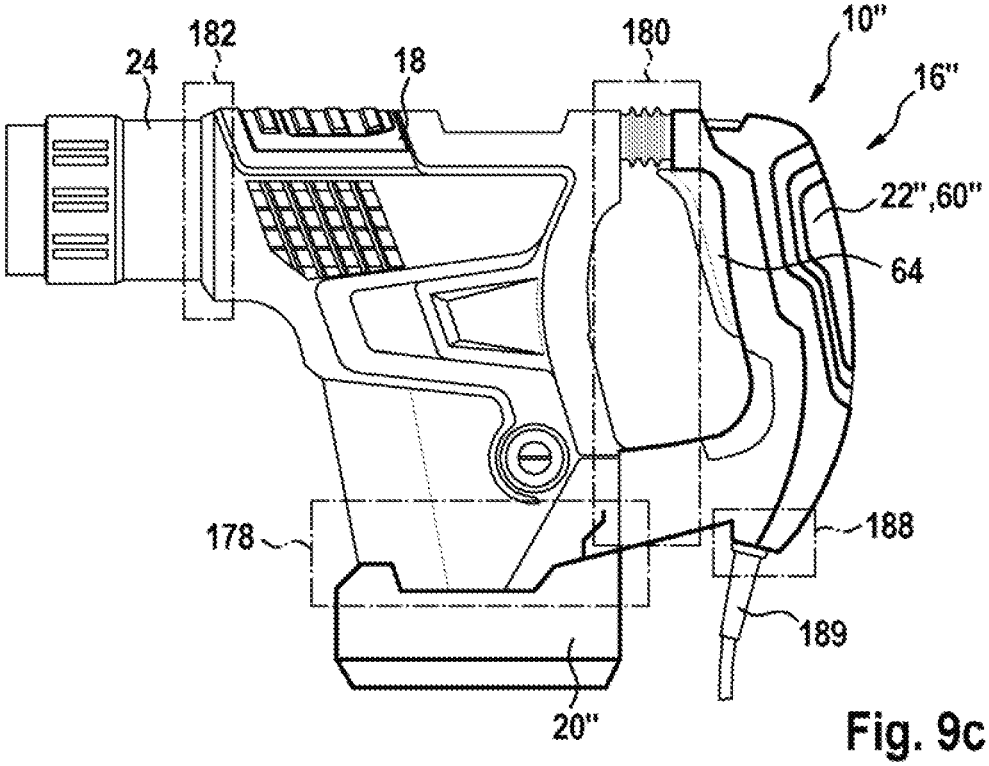
FIG. 9*c* a side view of a housing of a third hand-held power tool.
Figure 9D:
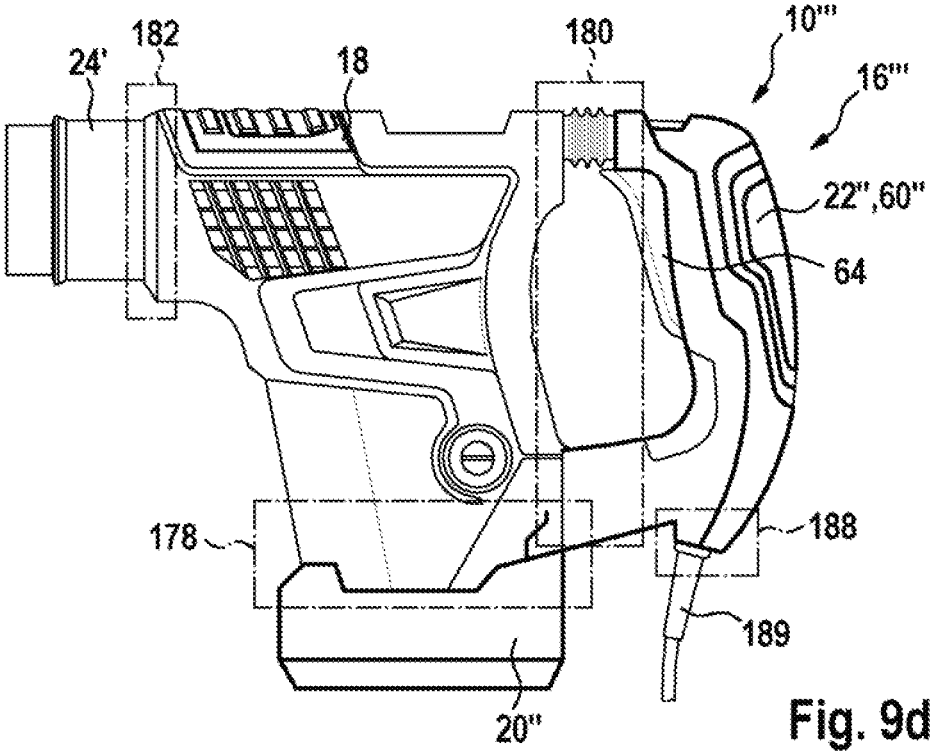
FIG. 9*d* a side view of a housing of a fourth hand-held power tool.

FIG. 9*c* shows the third hand-held power tool 10", and FIG. 9*d* shows the fourth hand-held power tool 10'". The third hand-held power tool 10" is realized as a mains-powered variant of the first hand-held power tool 10, and the fourth hand-held power tool 10'" is realized as a mains-powered variant of the second hand-held power tool 10'. The third and the fourth hand-held power tool 10", 10'" have a respectively differing second housing part 20", and a differing third housing part 22". Instead of the battery interface 70, the hand-held power tools 10", 10'" each have a mains-power interface 188, which is arranged at the lower end of the third housing part 22", which is realized as a handle 60". In the region of the mains-power interface 188, a mains-power cable 189, via which the hand-held power tools 10", 10'" can be supplied with energy, emerges from the housing 16", 16'" via an opening in the third housing part 22". Advantageously, in the case of the hand-held power tools 10, 10', 10", 10'", the housing interface 178, 180, 182 are identical to each other.

Alternatively, it is also conceivable that a further hand-held power tool has identical housing parts 18, 20, 24, and that only the third housing part 22 differs, in an alternative battery interface 70 for receiving an alternative hand-held power tool battery pack, which, for example, has a different number of battery cells.

Figure 10A:
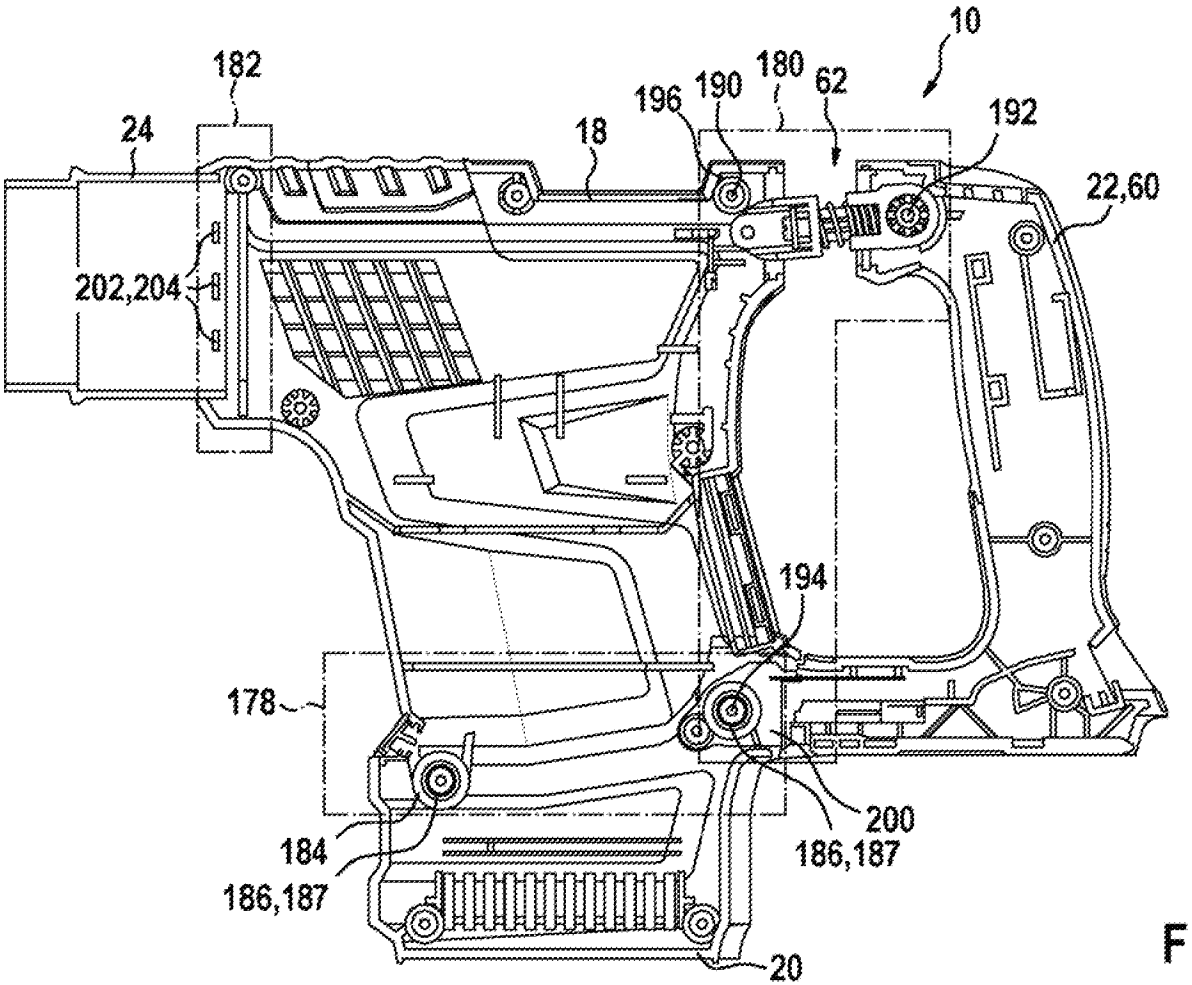
FIG. 10*a* a longitudinal section through the housing according to FIG. 9*a;*
Figure 10B:
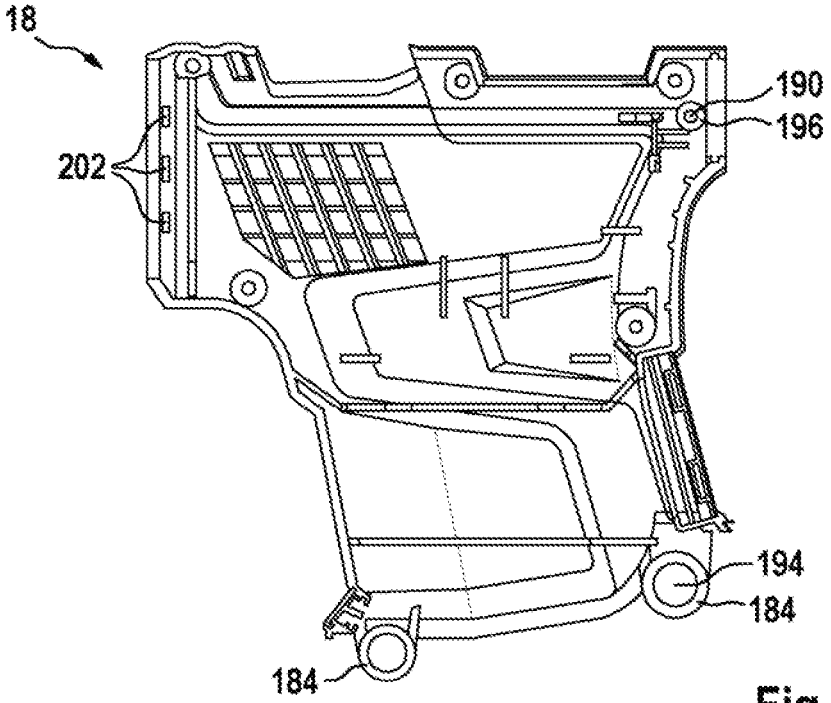
FIG. 10*b* a side view of a housing half-shell of the first housing part.
Figure 10C:
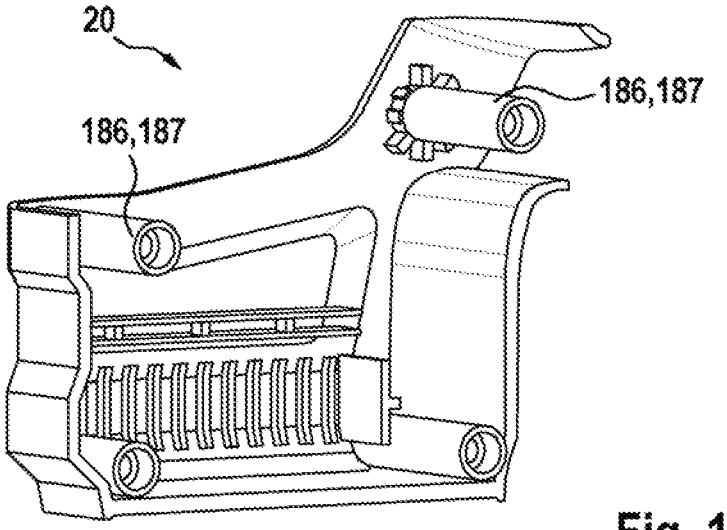
FIG. 10*c* a perspective view of a housing half-shell of the second housing part.
Figure 10D:
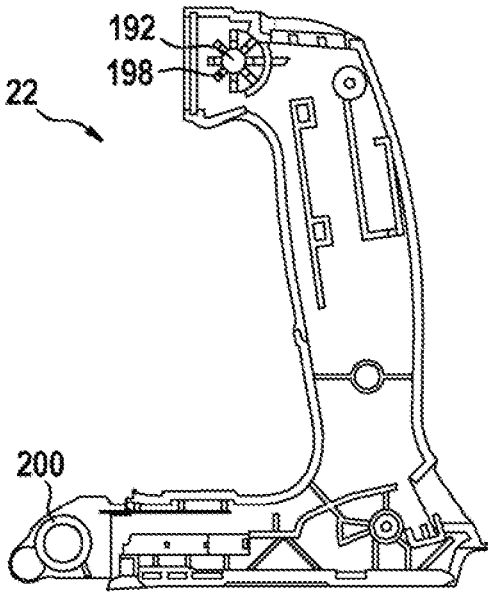
FIG. 10*d* a side view of a housing half-shell of the third housing part.
Figure 10E:
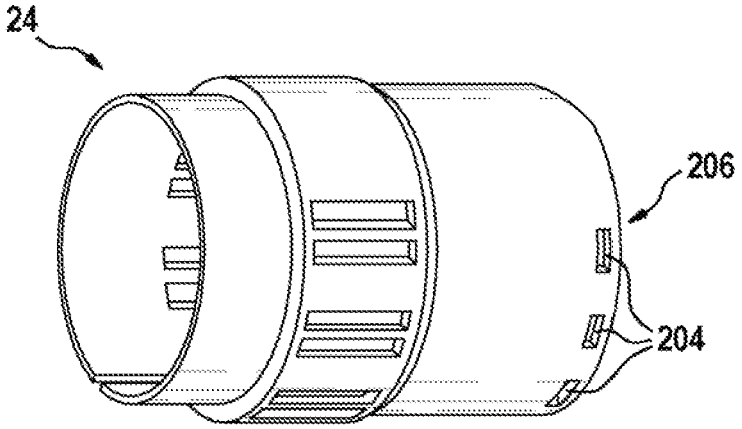
FIG. 10*e* a perspective view of the fourth housing part.

In FIG. 10*a-e*, the housing interfaces 178, 180, 182 are shown on the basis of the housing 16 of the first hand-held power tool 10. FIG. 10*a* shows a longitudinal section through the housing 16, and FIG. 10*b* to FIG. 10*e* each show a housing part 18, 20, 22, 24, or a housing half-shell of the housing parts 18, 20, 22, 24.

The first housing interface 178 has mutually corresponding connection elements 184, 186, which can be connected to each other in a positive manner. The connection elements 184 are assigned to the first housing part 18, and the connection elements 186 are assigned to the second housing part 20. The first housing part 18 has a pair of connection elements 184, which are realized as a circular receiver. In particular, the connection elements 184 are realized so as to constitute a single piece with the first housing part 18. The two connection elements 184 form the lower end of the first housing part 18. The second housing part 20 likewise has a pair of connection elements 186, which are realized as a pin-shaped extension, which extends perpendicularly, starting from the inner surfaces of the second housing part 20. In particular, the connection element 186 extends substantially perpendicularly in relation to the longitudinal and height extent of the hand-held power tool 10. The connection element 186 is advantageously designed as a screw boss 187, via which the two housing half-shells of the second housing part 20 can be connected by means of a screwed connection. In the connected state, the connection elements 186 are encompassed, or received, in a positive manner by the connection elements 184.

The second housing part 180 fastens the third housing part 22 in a pivotable manner to the first housing part 18. In total, the handle is pivotably fastened to the first housing part 18 via three rotation axes 190, 192, 194. The rotation axes 190, 192 are arranged at the upper end of the housing 16. The corresponding connection elements 196, 198 are realized as rotary bearing elements, which carry the damping unit 62. The connection elements 196, 198 are realized so as to constitute a single piece with the housing parts 18, 22. The damping unit 62 is realized as a sprung connecting-rod element. In addition, the third housing part 22 has a further connection element 200, realized as a circular receiver, which is realized such that it can be connected in a positive manner to the connection element 186 of the second housing interface 178. In particular, in the connected state, the connection element 186 of the second housing part 20 is received in a positive manner by the connection element 184 of the first housing part 18 and by the connection element 200 of the third housing part 22.

For the purpose of connecting the first housing part 18 to the fourth housing part 24, the third housing interface 182 has two corresponding connection elements 202, 204, which engage in each other in a positive manner. The connection element 202 is assigned to the first housing part 18, and is realized as an extension that extends inward, starting from the inner surface of the first housing part 18. For the purpose of assembly, the fourth housing part 24 is encompassed, at an end-face end region 206, by the two housing half-shells of the first housing part 18 in such a manner that the extensions 202 engage in the corresponding connection elements 204 of the fourth housing part 24, which are realized as openings. The fourth housing part 24 is thus fixed radially and, by the connection elements 202 of the first housing part 18, is fixed axially and in the direction of rotation about the working axis 58.

Figure 11A:
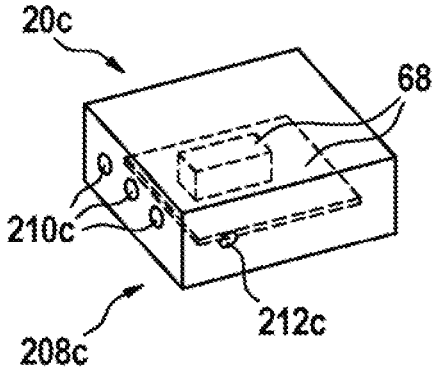
FIG. 11*a* a schematic view of an alternative second housing part.
Figure 11B:
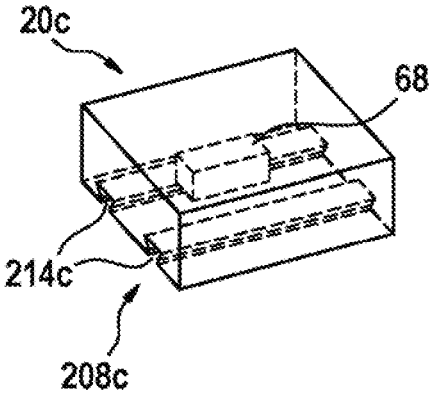
FIG. 11*b* a further schematic view of an alternative second housing part.
Figure 11C:
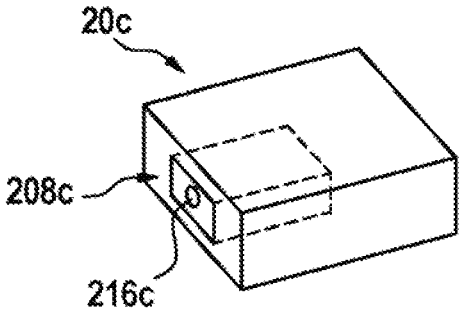
FIG. 11*c* a schematic view of a further alternative second housing part.

Alternatively, it is also conceivable for the hand-held power tools 10, 10', 10", 10"", which are constructed substantially as previously described, to have an alternative second housing part 20*c*. The alternative second housing part 20*c* comprises, in particular, a set of electronics 68 and an additional functional unit 208*c*. Differing additional functional units 208*c* are shown in FIG. 11*a* to FIG. 11*c*. The second housing part 20*c* can be connected to a further housing part of the hand-held power tool, as previously described, via a housing interface (not represented). The second housing part 20*c* may be realized as a single piece, barrel-type design or, as already previously described, as a housing half-shell design. In FIG. 11*a*, the additional functional unit 208*c* is realized as a lighting element 210*c*. The lighting elements 210*c* may emit, for example, a bright light, to illuminate a surface on which work is to be performed, or a colored light, to indicate a status of the hand-held power tool. The lighting elements 210*c* are arranged forward, in particular in the direction of working. Alternatively or additionally, it is conceivable for at least one lighting element 212*c* to be arranged at the side. Preferably, the side lighting element 212*c* is designed to indicate a status. It is conceivable, for example, that the tripping of a safety function, caused by jamming of the tool, a low battery state, an excessively high operating temperature, etc., can be indicated via the lighting elements 210*c* and/or the lighting element 212*c*.

In FIG. 1*b*, the additional functional unit 208*c* is realized as a coupling means 214*c* for an accessory device (not represented). For example, the coupling means 214*c* is realized as a pair of guide rails for a dust extraction device for a hammer drill. Via the coupling means 214*c*, advantageously, the hand-held power tool, in particular the second housing part 20*c*, can be connected to an accessory device.

In FIG. 11*c*, the additional functional unit 208*c* is realized as a distance measuring device 216*c* that, by means of laser measurement, measures the distance to the surface on which work is to be performed. Alternatively, further additional functional units 208*c* are also conceivable, such as, for example, a projection unit, for projecting information, patterns, a bubble level and/or a run-time counter, or an anti-theft module.

In particular, the disclosure relates to a system composed of two hand-held power tools, each having a housing, which has two housing parts that are fastened to each other via a housing interface, wherein the first housing part is fastened to the second housing part via a first housing interface. It is proposed that the second housing part of the first hand-held power tool differs from the second housing part of the further hand-held power tool from each other by an additional functional unit. Preferably, the first housing part in each case is realized as a motor housing, and the second housing part in each case is realized as an electronics-set housing. As a result, advantageously, by means of minor interventions in the housing design of the hand-held power tool, the latter can be equipped with a new and additional function.

The invention claimed is:

1. A system, comprising:

a first hand-held power tool and a second hand-held power tool, the first and second hand-held power tools each having a percussion mechanism, a motor, and a transmission that includes the percussion mechanism and that is configured to transmit a driving motion of the motor to an insert tool accommodated in a tool receiver, wherein the respective transmissions each have a guide tube that is identical in regions along a working axis and in which a striker is carried in an axially movable manner, the guide tube rotatably coupled to the motor via a first transmission unit, the striker configured to be driven in a linearly oscillating manner via a piston of a second transmission unit, wherein a ratio between a diameter of the tool receiver and a diameter of the guide tube of the first hand-held power tool is 1.8 times greater than a ratio between a diameter of the tool receiver and a diameter of the guide tube of the second hand-held power tool, and wherein a single-strike energy of the second hand-held power tool is mechanically reduced in comparison with a single-strike energy of the first hand-held power tool.

2. The system as claimed in claim 1, wherein a first crank stroke of the second transmission unit of the second hand-held power tool is reduced in comparison with a second crank stroke of the second transmission unit of the first hand-held power tool.

3. The system as claimed in claim 1, wherein the respective pistons of the first and second hand-held power tools are driven via respective eccentric units, and wherein an eccentricity of the eccentric unit of the second hand-held power tool is less than an eccentricity of the eccentric unit of the first hand-held power tool.

4. The system as claimed in claim 1, wherein a first air-spring length of the percussion mechanism of the first hand-held power tool differs from a second air-spring length of the percussion mechanism of the second hand-held power tool.

5. The system as claimed in claim 1, wherein a bearing distance of the percussion mechanism of the first hand-held power tool is equal to a bearing distance of the percussion mechanism of the second hand-held power tool.

6. The system as claimed in claim 1, wherein a strike point of the first hand-held power tool is the same as a strike point of the second hand-held power tool.

7. The system as claimed in claim 1, wherein the first and second hand-held power tools each have a B percussion damping system that are identical to each other.

8. The system as claimed in claim 1, wherein the first and second hand-held power tools each have a transmission housing, and wherein mechanical components within each transmission housing are at least 80% identical.

9. The system as claimed in claim 1, wherein a diameter of the tool receiver of the second hand-held power tool is under 18 mm, and wherein the ratio between a diameter of the guide tube and the diameter of the tool receiver of the second hand-held power tool lies in a range of between 2.8 and 3.4.

10. The system as claimed in claim 2, wherein the first crank stroke is reduced by 20% in comparison with the second crank stroke.

11. The system as claimed in claim 4, wherein the first air-spring length is greater than the second air-spring length.

12. The system as claimed in claim 9, wherein the diameter of the tool receiver of the second hand-held power tool is 10 mm, and wherein the ratio between the diameter of the guide tube and the diameter of the tool receiver of the second hand-held power tool lies in a range of between 2.9 and 3.1.

* * * * *